US007269942B2

(12) United States Patent
Bailey

(10) Patent No.: US 7,269,942 B2
(45) Date of Patent: Sep. 18, 2007

(54) WALL FLOW PARTICULATE TRAP SYSTEM

(75) Inventor: John M. Bailey, Dunlap, IL (US)

(73) Assignee: Illinois Valley Holding Company, Dunlay, IL (US)

( * ) Notice: Subject to any disclaimer, the term of this patent is extended or adjusted under 35 U.S.C. 154(b) by 213 days.

(21) Appl. No.: 10/846,780

(22) Filed: May 14, 2004

(65) Prior Publication Data

US 2004/0226290 A1 Nov. 18, 2004

Related U.S. Application Data

(60) Provisional application No. 60/470,942, filed on May 15, 2003.

(51) Int. Cl.
*F01N 3/00* (2006.01)

(52) U.S. Cl. ..... 60/297; 60/287; 60/291; 60/292; 60/295; 60/296; 60/311; 60/324; 95/148; 95/273; 95/278; 95/285; 55/284; 55/282.3; 55/302; 55/303; 55/524

(58) Field of Classification Search ..... 60/274, 60/287, 291, 292, 295, 296, 297, 303, 311, 60/324; 95/129, 8, 148, 273, 278, 285; 55/284, 55/282.3, 302, 303, 385.3, 394, 428.1, 429, 55/433, 523, 524, DIG. 10, DIG. 30
See application file for complete search history.

(56) References Cited

U.S. PATENT DOCUMENTS 2,778,493 A 1/1957 Kreidler ..... 207/3
3,002,615 A 10/1961 Lemelson ..... 207/2
3,144,682 A 8/1964 Thielfoldt ..... 18/14
3,352,003 A 11/1967 Murtha
3,422,648 A 1/1969 Lemelson ..... 72/8

(Continued)

FOREIGN PATENT DOCUMENTS

JP 04-031613 3/1992

OTHER PUBLICATIONS www.dieselnet.com/tech/dpf_regen.html; *Diesel Filter Regeneration* [subscription], pp. 1-16; DieselNet Technology Guide, Diesel Particulate Filters.

(Continued)

*Primary Examiner*—Binh Q. Tran
(74) *Attorney, Agent, or Firm*—Husch & Eppenberger LLC; H. Frederick Rusche

(57) ABSTRACT

A wall-flow particulate trap system regenerated by reverse flow of filtered exhaust gas through porous walls of a plurality of tubular passages is disclosed. The system includes a particulate trap having an inlet and an outlet, the particulate trap adapted to receive engine exhaust gas; a mode valve assembly offset from the inlet of the particulate trap; a remote actuated relief valve offset from the outlet of the at least one particulate trap a duct rotor intermediate the particulate trap and the mode valve assembly, the duct rotor having a first end and a second end, the second end of the duct rotor in operative communication with the mode valve assembly and the first end of the duct rotor in fluid communication with the inlet of the particulate trap; and a rotor drive in driving connection with the duct rotor.

28 Claims, 20 Drawing Sheets

U.S. PATENT DOCUMENTS

| | | | | |
|---|---|---|---|---|
| 3,708,253 | A | 1/1973 | Lemelson | 425/155 |
| 3,932,090 | A | 1/1976 | Brumlik | 425/381 |
| 4,159,564 | A | 7/1979 | Cooper, Jr. | 29/727 |
| 4,178,145 | A | 12/1979 | Hamamoto et al. | 425/199 |
| 4,298,328 | A | 11/1981 | Frost | 425/376 A |
| 4,384,841 | A | 5/1983 | Yamamoto et al. | 425/461 |
| 4,415,344 | A | 11/1983 | Frost et al. | 55/523 |
| 4,468,366 | A | 8/1984 | Socha, Jr. | 264/177 R |
| 4,550,005 | A | 10/1985 | Kato | 264/177 R |
| 4,801,419 | A | 1/1989 | Ward et al. | 264/288.4 |
| 4,833,883 | A | 5/1989 | Oda et al. | 60/311 |
| 4,840,028 | A | 6/1989 | Kusuda et al. | 60/303 |
| 4,875,336 | A * | 10/1989 | Hayashi et al. | 60/286 |
| 4,979,889 | A | 12/1990 | Frost | 425/192 R |
| 4,987,738 | A | 1/1991 | Lopez-Crevillen et al. | 60/286 |
| 5,024,054 | A | 6/1991 | Barris et al. | 60/274 |
| 5,063,737 | A | 11/1991 | Lopez-Crevillen et al. | 60/286 |
| 5,065,574 | A | 11/1991 | Bailey | 60/274 |
| 5,085,049 | A | 2/1992 | Rim et al. | |
| 5,171,337 | A | 12/1992 | Pollock | 55/284 |
| 5,212,948 | A | 5/1993 | Gillingham et al. | 60/288 |
| 5,293,742 | A | 3/1994 | Gillingham et al. | 60/288 |
| 5,566,545 | A | 10/1996 | Kijikata et al. | 60/274 |
| 5,809,777 | A | 9/1998 | Kawamura | 60/303 |
| 5,930,994 | A | 8/1999 | Shimato et al. | 60/274 |
| 5,930,995 | A | 8/1999 | Watanabe et al. | 60/311 |
| 5,941,066 | A | 8/1999 | Araki et al. | 60/280 |
| 5,956,944 | A | 9/1999 | Dementhon et al. | 60/274 |
| 5,966,928 | A | 10/1999 | Igarashi | 60/274 |
| 6,023,929 | A | 2/2000 | Ma | 60/295 |
| 6,206,675 | B1 | 3/2001 | Be Vier | 425/190 |
| 6,233,926 | B1 | 5/2001 | Bailey et al. | 60/295 |
| 6,314,722 | B1 | 11/2001 | Matros et al. | 60/274 |
| 6,315,545 | B1 | 11/2001 | Inoue | 425/192 R |
| 6,989,045 | B2 * | 1/2006 | Bailey et al. | 95/129 |

OTHER PUBLICATIONS www.dieselnet.com/tech/dpf_wall.html; *Wall-Flow Monoliths* [subscription], pp. 1-26; DieselNet Technology Guide, Diesel Filter Materials.

* cited by examiner

WALL FLOW PARTICULATE TRAP SYSTEM

CROSS-REFERENCE TO RELATED APPLICATIONS

This application claims priority of provisional application Ser. No. 60/470,942 filed on May 15, 2003.

STATEMENT REGARDING FEDERALLY SPONSORED RESEARCH OR DEVELOPMENT

Not Applicable.

APPENDIX

Not Applicable.

FIELD OF THE INVENTION

The present invention relates generally to the field of diesel or other internal combustion engine exhaust systems, and more specifically, to an apparatus and method for reducing the release of emissions and particulate in the atmosphere, and to an apparatus and method for regenerating exhaust traps by reverse flow of filtered exhaust gas through porous walls of a plurality of tubular passages.

BACKGROUND OF THE INVENTION

The U.S. Environmental Protection Agency (EPA) has put in place increasingly stringent standards for particulate and NOx emissions. For example, the standards that take place in October, 2002 include 0.1 g/hp-hr for particulates and 2.0 g/hp-hr for NOx. In 2007 these will be further reduced to 0.01 g/hp-hr for particulates and 0.2 g/hp-hr or NOx. Industry has been conducting an intensive program toward achievement of these requirements.

PCT Publication WO 03086580 identifies a method of filtering or trapping the particulate from the exhaust and periodically disposing of the collected soot and ash. In common with most other approaches, the system disclosed in the WO 03086580 publication uses a monolithic ceramic trap having passages with porous walls through which exhaust is passed to filter out the smoke particles at very high (90-97%) trapping efficiency. These systems use either wall flow or cross flow traps in multi-trap or single trap configurations. Each of these systems is capable of achieving the EPA particulate standards for 2002 and 2007.

FIGS. 1A and 1B show the wall-flow single trap particulate trap system from the WO 03086580 publication. The principal parts are a trap structure 166, a wall flow particulate trap 160, a rotating duct/valve 162, a rotating duct/valve drive 163, a remote actuated relief valve 173, a seal 166*a*, a purge duct 169 and a mode valve 168.

The wall-flow particulate trap systems disclosed in the WO 03086580 publication use cordierite traps of the well known wall-flow type to filter the exhaust gas by passing it through the porous walls of trap channels. This action removes 90-98% of the particulate and this collects on the inside surfaces of the passages as a layer or cake which after a few hours of operation increases the engine backpressure and must be removed to prevent adverse affect on engine performance.

Most competitive trap systems remove this layer of soot by burning it in the trap. To avoid excessive temperatures during this operation, expensive noble metal catalytic coatings are required and ultra low sulfur fuel must be used which will not be broadly available for a number of years. Also, the engines must be operated at a relatively high average load factor or auxiliary heating methods must be used to assure that burn-out occurs before too much soot is collected. Finally, the incombustible ash remains in the traps resulting in increased backpressure and the traps must be periodically cleaned in an expensive and disruptive maintenance operation.

The particulate trap systems disclosed in the WO 03086580 publication preclude the above problems by using a reverse flow of pre-filtered exhaust gas to create a constant reverse pressure drop across the trap, or portions thereof, to dislodge and erode the accumulated soot and ash cake and to transport the dislodged particles to an external chamber where in the soot and/or ash are separated from the purge flow for combustion of the soot and storage of the incombustible ash. This approach permits the use of traps of low cost cordierite and the regeneration process has little or no adverse affect on engine performance. This system will provide the 0.01 g/hp-hr particulate emissions standards required by the EPA regulations in the future.

There remains a need in the art for a wall-flow single trap particulate trap system that is more compact, less expensive and adaptable to a broad range of vehicles, such as highway trucks, transit buses, school buses, off-highway and many other vehicles.

SUMMARY OF THE INVENTION

The present invention relates to a wall-flow particulate trap system for filtering exhaust gases. The particulate trap system includes a particulate trap, a mode valve assembly, a remote actuated relief valve, a duct rotor, and a rotor drive in driving connection with the duct rotor.

The duct rotor drive rotates the duct rotor. As the duct rotor rotates, it aligns a central duct with one or more passages of the particulate trap. Depending upon the mode of the system, exhaust flows into or out of the central duct. In other words, the central duct is operative for both normal exhaust flow during filtration and reverse exhaust flow for particulate trap regeneration.

The mode valve assembly and the remote actuated relief valve cooperate to maintain a specified mode of system operation. By operation of the mode valve assembly and the remote actuated relief valve, a control system selects a normal filtration mode or a regeneration mode.

In some embodiments, the particulate trap system may have more than one particulate trap.

In some embodiments, the rotor drive is a ratchet drive mechanism. The ratchet drive has the advantage of operation over a wide variation of tolerances.

Further features and advantages of the present invention, as well as the structure and operation of various embodiments of the present invention are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

In this Detailed Description of the Preferred Embodiments, all values given are to be considered as approximate.

Figure 1B:
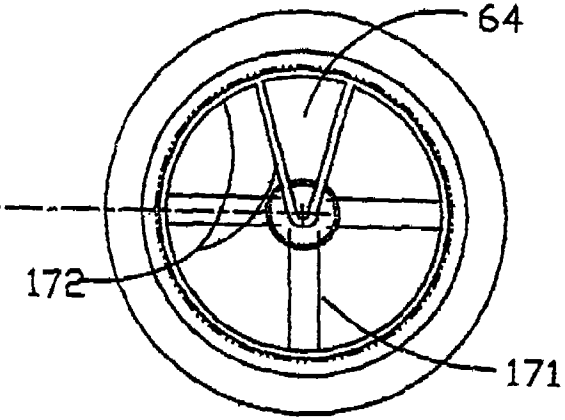
FIG. 1B is a sectional view along section lines A-A in FIG. 1A.
Figure 1A:
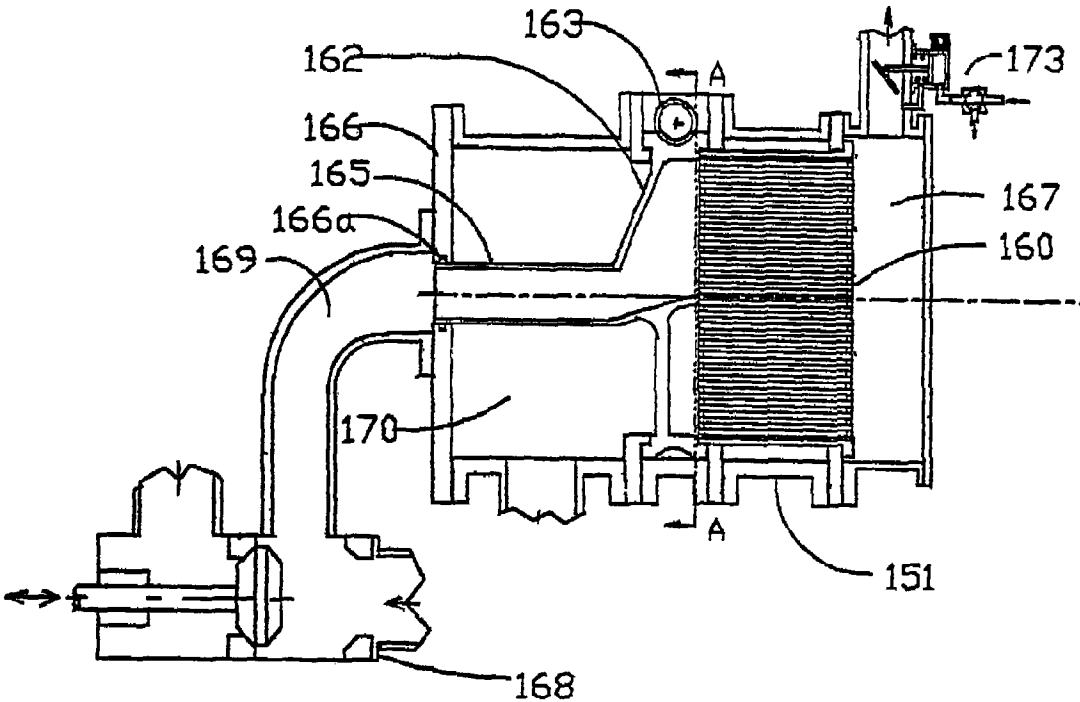
FIG. 1A is a sectional side view of a wall-flow single trap configuration.
Figures 2A, 2B:
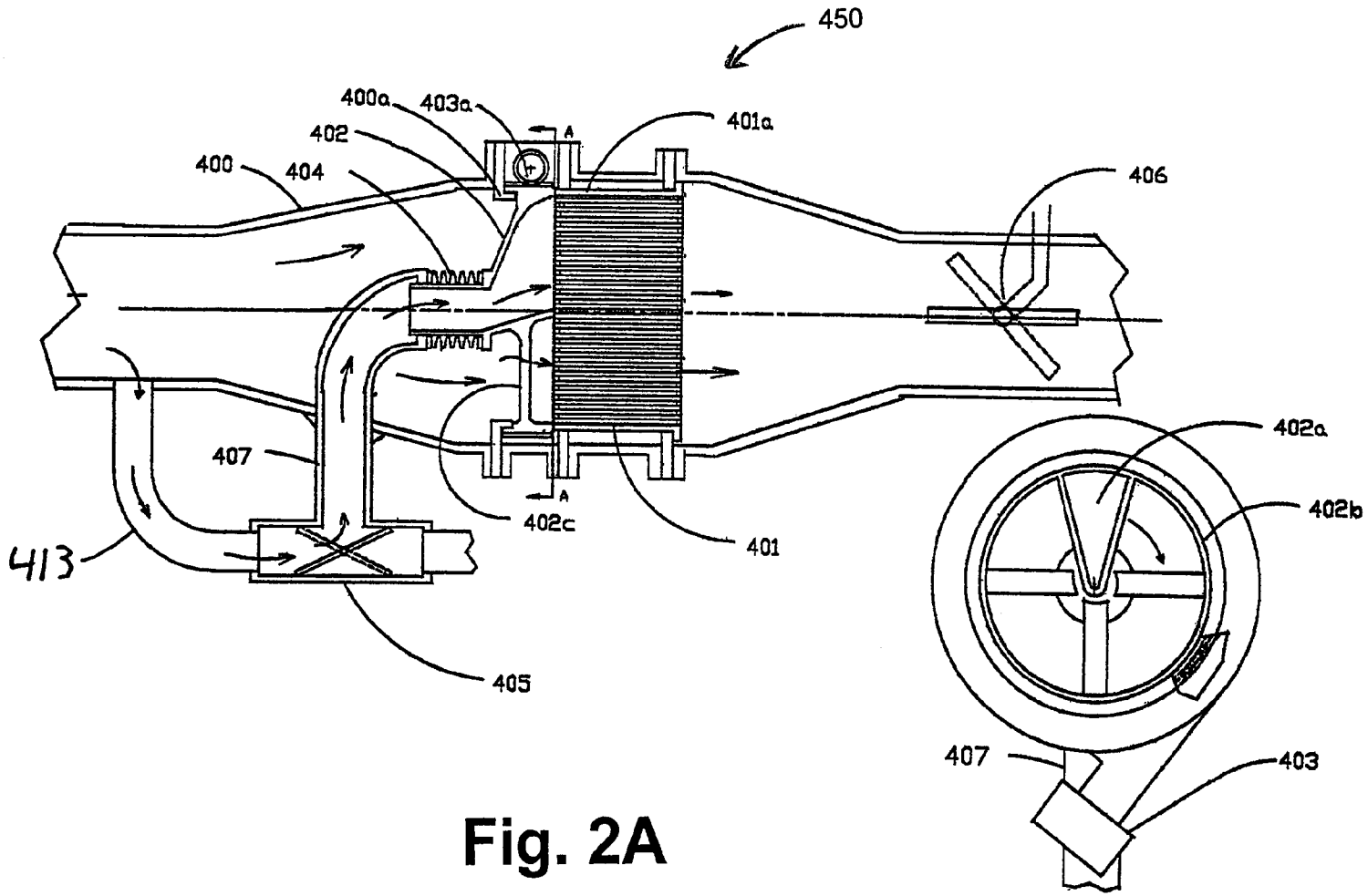
FIG. 2A is a sectional side view of a single trap configuration of the wall-flow particulate trap system in a normal filtration mode of operation.
FIG. 2B is a sectional view along section lines A-A in FIG. 2A.
Figure 3:
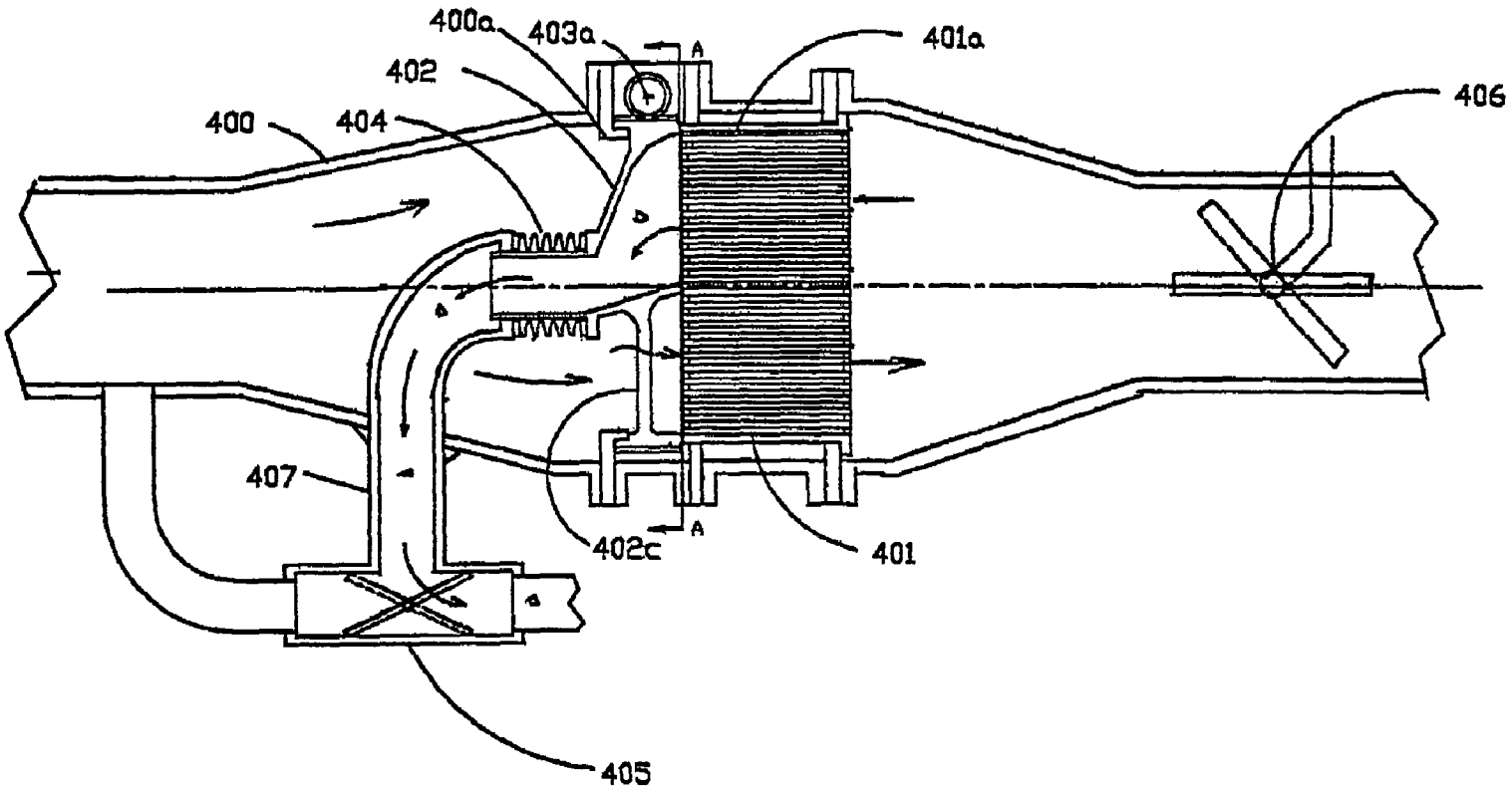
FIG. 3 is a sectional side view of the single trap configuration of the wall-flow particulate trap in a regeneration mode of operation.
Figure 4:
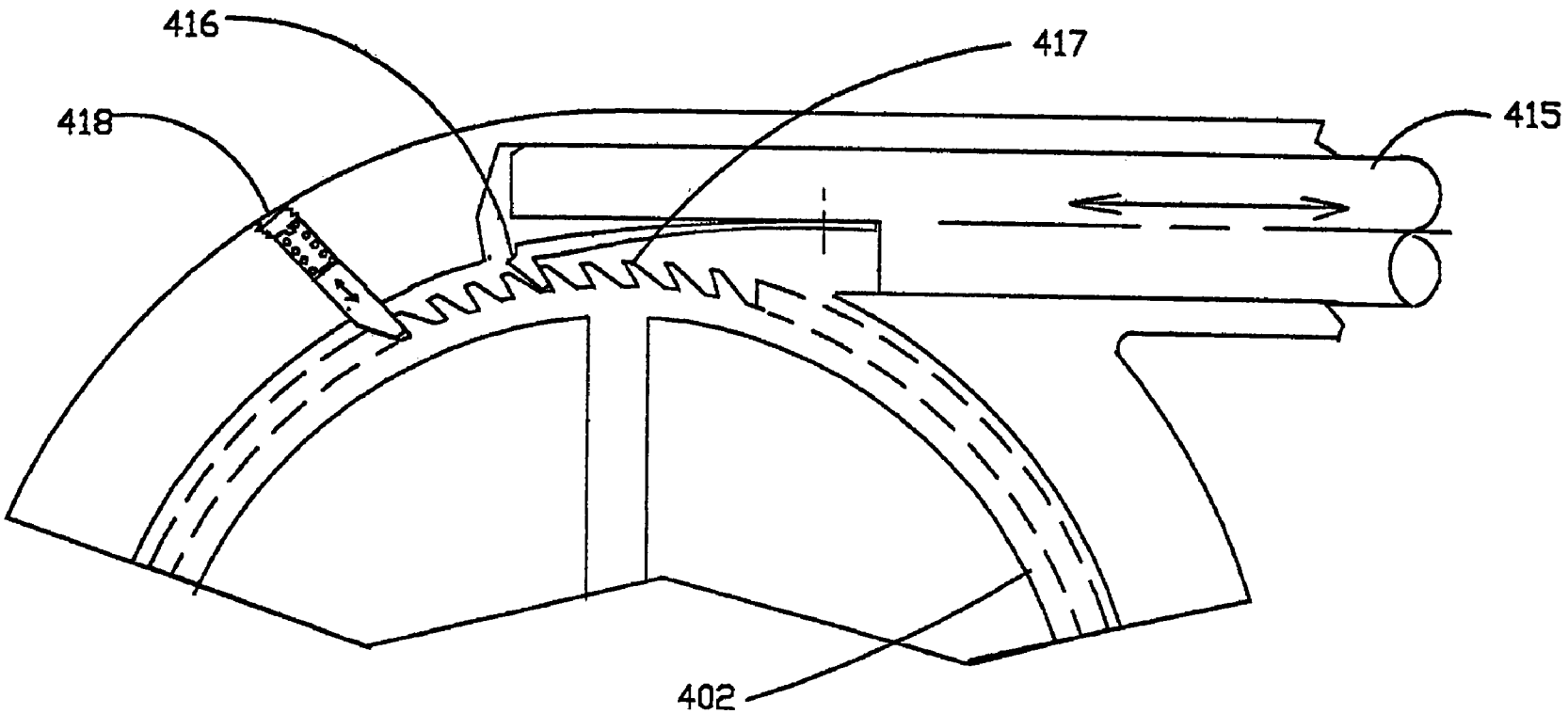
FIG. 4 illustrates a ratchet device for rotating the duct rotor component.

Referring to the accompanying drawings in which like reference numbers indicate like elements, FIGS. 2-4 generally illustrate a wall-flow single trap particulate trap system 450. The particulate trap system 450 is adapted to be disposed in an engine exhaust gas line (not shown). FIGS. 2A and 2B illustrate the wall-flow single trap particulate trap system in normal filtration mode. The major components are a trap structure shown generally at 400, a wall-flow particulate trap 401, a combination duct and valve rotor 402, a rotor drive 403, a seal 404, a mode valve 405, a remote actuated relief valve 406, and a separator and igniter (not shown). The trap structure 400 is in fluid communication with the exhaust gas line.

The duct rotor 402 is rotated continuously at a very slow rate of speed such as one revolution per fifteen minutes. The duct rotor 402 includes spokes 402*c*. The duct rotor 402 is piloted by structural member 400*a* and rotated by a gear set 403*a*, for example a helical or a worm gear set. Alternatively, the duct rotor 402 is rotated by a ratchet mechanism. FIG. 2B shows the rotational drive mechanism 403 revolved clockwise about 120 degrees such that the motor or other drive device is aligned with a purge duct 407. This permits most of the periphery of the trap system to have about the same diameter as the trap 401. The duct rotor 402 is configured to contain a duct section 402*a* that passes with very close clearance along a finished face of the wall-flow trap 401. As indicated by FIG. 2B, the pie-shaped duct section 402*a* of the rotor 402 also is joined with an outer ring 402*b* that rubs against an outer tube 401*a*, thus effecting a positive seal. The duct rotor 402 is pressed with a small but constant force against the entrance face of the trap 401 by the seal 404, for example a bellows spring. This assures a positive seal regardless of the dimensional tolerance of the various components or wear of the faces. Alternatively, a system of caged Belleville springs is used to provide an even and constant force.

The purge duct 407 is permanently mounted in the trap structure 400, and the face where the seal 404 abuts is machined. The purge duct 407 also connects with the mode valve 405 where it either receives engine exhaust when the mode valve is in the solid position or passes purge flow from the trap 401 to the separator and igniter when the mode valve is in the dashed position (in this figure it is assumed to be in the solid position). The remote actuated relief valve 406 is wide open in the normal filtration mode shown in FIG. 2A It is actuated to provide a substantially constant 30 inches of water (gauge) (hereinafter "in. W.G.") exhaust pressure at the exit of the trap during regeneration mode.

In operation, when the unit is in normal filtration mode, exhaust gas enters the trap structure 400 as indicated and a majority of the exhaust passes around the spokes 402*c* of the duct rotor 402 and thence through the trap 401 wherein it is filtered. A minority of the exhaust flow passes through a small tube 413 to the mode valve 405, thence through the pie-shaped section 402*a* and through the particulate trap 401 wherein it is similarly filtered by the affected trap passages. This action continues until the pressure drop across the trap 401 reaches about 30 in. W.G. At approximately this engine backpressure, the trap 401 should be cleaned or regenerated.

FIG. 3 shows the wall flow single trap particulate trap system in the regeneration mode. When a control system indicates regeneration is necessary by sensing engine backpressure or some other parameter, the relief valve 406 is actuated to provide a substantially constant pressure downstream of the trap 401. The mode valve 405 is then moved to the dashed position thus permitting the pre-filtered exhaust to pass back through the tubes or passages that connect with the duct rotor section 402*a*. This reverse flow at a substantially constant 30 in. W.G. differential pressure dislodges and erodes the soot accumulated on the trap wall surfaces and carries the dislodged particles out through the purge duct to an external chamber. There the soot is ignited and burned and the incombustible ash is stored for periodic removal. There conditions are maintained until the duct rotor 402 has made at least one complete revolution. Upon completion of the regeneration mode, the mode valve 405 is moved to the solid position and the relief valve is deactivated and returned to the wide open position. The system then continues in normal filtration mode until regeneration is again required.

In the depicted embodiments of FIGS. 2 and 3, it is assumed that the duct rotor 402 is rotated at a constant speed by means of the rotor drive 403, such as a small electrical or air motor, that is connected to the duct rotor 402 by a small helical gear set shown at 403*a*. FIG. 4 illustrates an alternative method of effecting rotation. In this design, which would replace the motor drive at 403, a linear actuation drive device 415 that is periodically reciprocated is used to rotate the duct rotor 402 by a ratchet arrangement. As examples, the linear actuation device 415 may be reciprocated by an electrical solenoid or air actuated piston. The ratchet arrangement contains an integral pawl and spring 416 that engages teeth 417 located at the periphery of the duct rotor 402. A spring loaded detent 418 is used to hold the duct rotor 402 in position between movements by the integral pawl and spring 416.

The angular movement of the duct rotor 402 during each actuation by the integral pawl and spring 416 can be selected as desired from a very small amount, such as a single tooth, to provide a substantially continuous rotation. The use of the ratchet drive for this type rotation may be preferable to a motor and gear drive because it may be simpler, more compact and less expensive. It also provides a very simple digital method of selecting a desired duct rotor speed. It may be desirable to advance the rotor sufficiently to instantly expose a complete new set of passages to the duct section 402*a*. The rotational movement and shape of the duct section 402*a* will have to be rationalized with the geometry of the wall-flow trap to assure that all passages are eventually exposed to regeneration reverse flow.

Figures 5A, 5B:
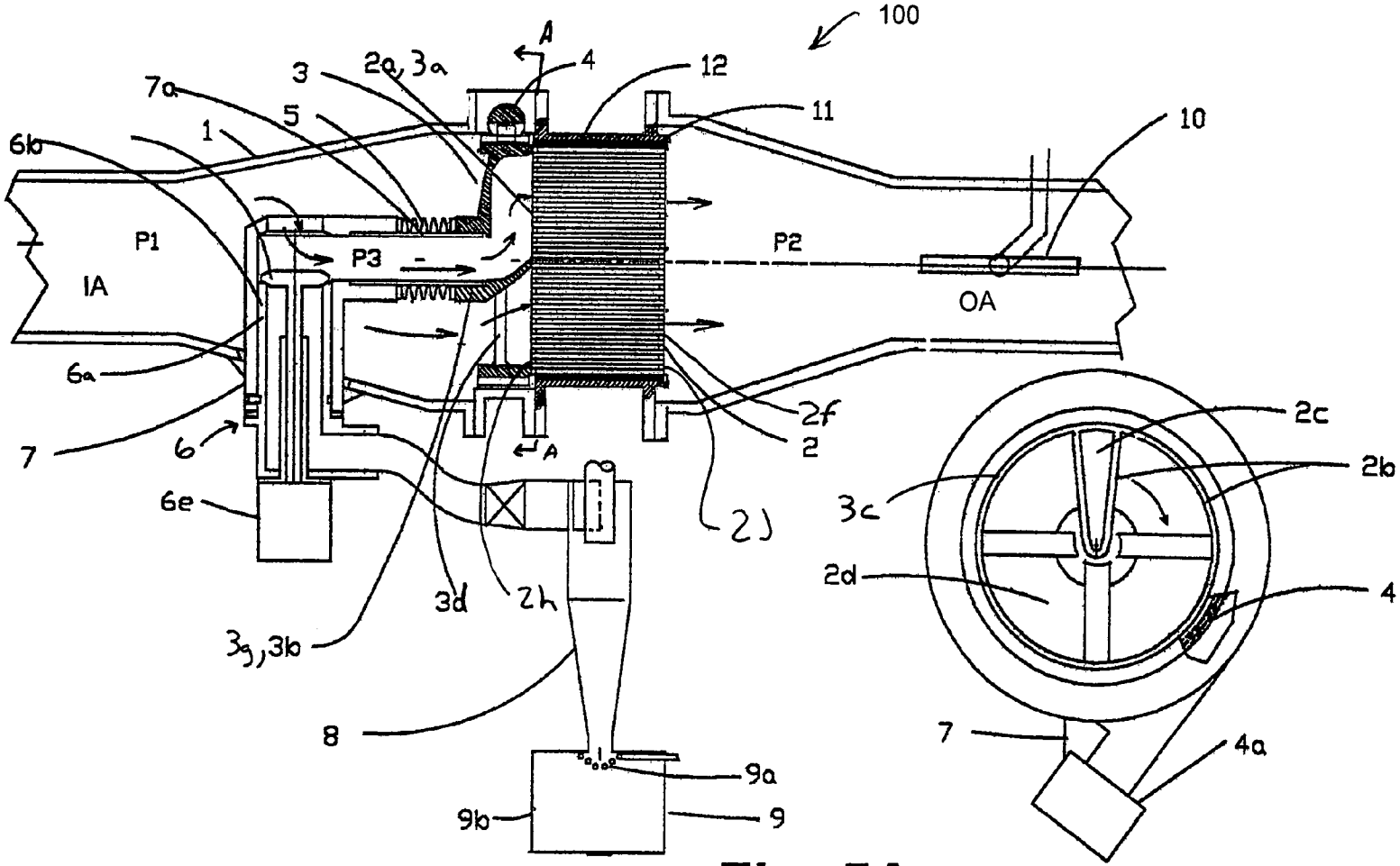
FIG. 5A is a sectional side view of the single trap configuration of the wall-flow particulate trap system in the normal filtration mode of operation.
FIG. 5B is a sectional view along section lines A-A in FIG. 5A.

FIGS. 5A and 5B illustrate a second embodiment of the wall-flow trap particulate trap system in the normal filtration mode, generally indicated by numeral reference 100. The major components are a trap structure shown generally at 1, a particulate trap 2 having passages 2*f*, a combination duct and valve rotor 3, a rotor drive 4, a seal 5, a mode valve assembly 6, a purge duct 7, a separator 8, an igniter and ash storage chamber shown generally at 9, and a remote actuated relief valve 10. The trap structure includes an exhaust gas inlet area IA and an exhaust gas outlet area 0A. The particulate trap 2 has an inlet 2*h* and an outlet 2*j*. The inlet 2*h* is in fluid communication with the exhaust gas inlet area IA, and the outlet 2*j* is in fluid communication with the exhaust gas outlet area OA. The mode valve assembly 6 is offset, or spaced apart, from the inlet 2*h* of the particulate trap system 2 and operatively connected to the duct rotor 3. In the depicted embodiment, the purge duct 7 connects the mode valve assembly 6 and the duct rotor 3. The remote actuated relief valve 10 is located within the exhaust gas outlet area OA and offset, or spaced apart, from the outlet 2*j* of the particulate trap 2.

The mode valve assembly 6 is incorporated as part of the particulate trap system structure 1 in lieu of the external mode valve 405. While the function is basically the same as the valve depicted in FIGS. 2-4, the new location of the mode valve assembly 6 makes the entire trap assembly more compact, simplifies the piping and reduces the total cost.

In the embodiment depicted in FIG. 5A, the particulate trap system includes a single wall-flow type trap. As an example, the trap may be of the kind produced by Corning, Inc. of Houghton Park, Corning, N.Y. While in the depicted embodiment only one particulate trap is shown, those skilled in the art will understand that the system may include more than one particulate trap. While the depicted particulate trap has a cylindrical shape, those skilled in the art will realize that other shapes may be used without departing from the scope of the present invention.

In the depicted embodiments, the particulate trap 2 is a Corning® DuraTrap RC 200/19. However, those skilled in the art will understand that other particulate traps, the Corning® EX-80 100/17 for example, may be used. The RC 200/19 traps presents a more uniform passage configuration and present a larger cordierite total surface wear area at the duct rotor 3 and trap module 2 interface. In addition, because more passages per square inch are used and these have thicker walls, the RC 200/19 has a greater mechanical integrity factor than the EX-80 trap configuration.

The duct rotor 3 includes a first end 3*a* and a second end 3*b*. The second end 3*b* is connected to the purge duct 7, and the first end 3*a* is pressed against an inlet face 2*a* of the trap 2. The seal 5 provides just enough force to assure that the first end 3*a* remains in contact with the inlet face 2*a* under all engine operating conditions. In the depicted embodiment, the seal 5 comprises a bellows spring.

The contact between the trap 2 and a rotor outer ring 3*c* and walls of the duct rotor 3 form a "footprint" as shown at 2*b* of FIG. 5B. This results in a minor duct section 2*c* at the entrance of the trap 2 that is isolated from the major duct section 2*d* of the trap 2. In the depicted embodiment, the minor duct section 2*c* formed by the duct rotor 3 at the trap face 2*a* encompasses about 20-30 degrees of the trap face near the trap outer diameter. This encloses about 20-30 channels or passages 2*f* with a 12 inch diameter trap. The minor duct section 2*c* is selected to assure that all inlet passages 2*f* are fully open for the same period of time during rotation of the duct rotor 3, even at the center of the trap face 2*a*. The duct rotor rotational speed and dimensions of the minor duct section are selected to assure that all inlet passages 2*f* of the trap are open long enough to provide complete removal of the soot and/or ash cake by the reverse flow pressure drop. It is preferred that the minor duct section 2*c* be made as small as practical to minimize the reverse volumetric flow rate of the pre-filtered exhaust gas. Additionally, the dimensions of the minor duct section 2*c* will vary in accordance with the diameter of the particulate trap.

It will be noted that spokes 3*d* of the duct rotor 3 are spaced back from the trap entrance face 2*a*. The spokes are for structural purposes only and have no control function. The duct rotor 3 is supported by a pilot bearing 3*g* and an outside diameter of tubular member 7*a*, which is part of the purge duct 7. The duct rotor 3 is continuously rotated by the rotor drive 4 whenever the engine is in operation.

In the normal engine operating mode, the remote actuated relief valve 10 is in its fully open position. A mode valve 6*a* of the mode valve assembly 6 is spring loaded by an actuator (not shown) in the shown position to seat against a mode valve auxiliary member 6*b*. This permits a small part of the engine exhaust that enters the particulate trap assembly 2 to pass into the purge duct 7 and thence through passages 2*f* of the trap 2 that are uncovered by the duct rotor 3 at any instant to be filtered. The remainder of the exhaust gas passes around the spokes 3*d* of the duct rotor 3 and is free to enter any of the remainder of uncovered passages 2*f* of trap 2, whereby it is also filtered. It will be noted that under these conditions the pressures P1 and P3 are equal resulting in no pressure difference across the duct rotor 3, no leakage and no opportunity for any of the exhaust gas to pass to the atmosphere without first having to pass through the trap passages 2*f* and filtered.

During this normal engine operation, the exhaust gas will all be filtered while the duct rotor 3 is very slowly rotated at about 4 to 6 revolutions per hour. After several hours of operation, the trap surfaces will have built up a layer of soot and/or ash which will significantly increase the pressure drop across the trap 2, and, consequently, the engine backpressure and the particulate trap 2 will have to be regenerated or cleaned.

The pressure drop across the trap 2 used to determine when regeneration should occur may vary with the application but generally is in the order of 20-30 in. W.G. It is important that the soot loading of the trap 2 at the time of regeneration does not exceed about 10 g/liter for the Corning® RC 200/19 trap or 6 g/liter for the Corning® EX-80 trap to prevent uncontrolled regeneration and resultant trap failure in the event that soot ignition occurs at high engine exhaust temperature. The backpressure corresponding to these soot loadings are determined analytically and/or empirically for various trap sizes. Because the present invention can be regenerated on command without need for high temperatures and with a minimal amount of wasted energy, the control should be designed to initiate regeneration at a rather low backpressure for trap safety and minimal adverse effect on engine performance.

The reverse flow pressure drop is controlled by the design of the remote actuated relief valve 10. The minimum reverse flow pressure required to provide quick and reliable regeneration is in the range of 20-40 in. W.G., and preferably 30 in. W.G. The maximum reverse flow pressure drop, which is primarily important to prevent unnecessary adverse effect on engine performance during regeneration, is in the range of 30-50 in. W.G., and preferably 40 in. W.G.

Figure 6:
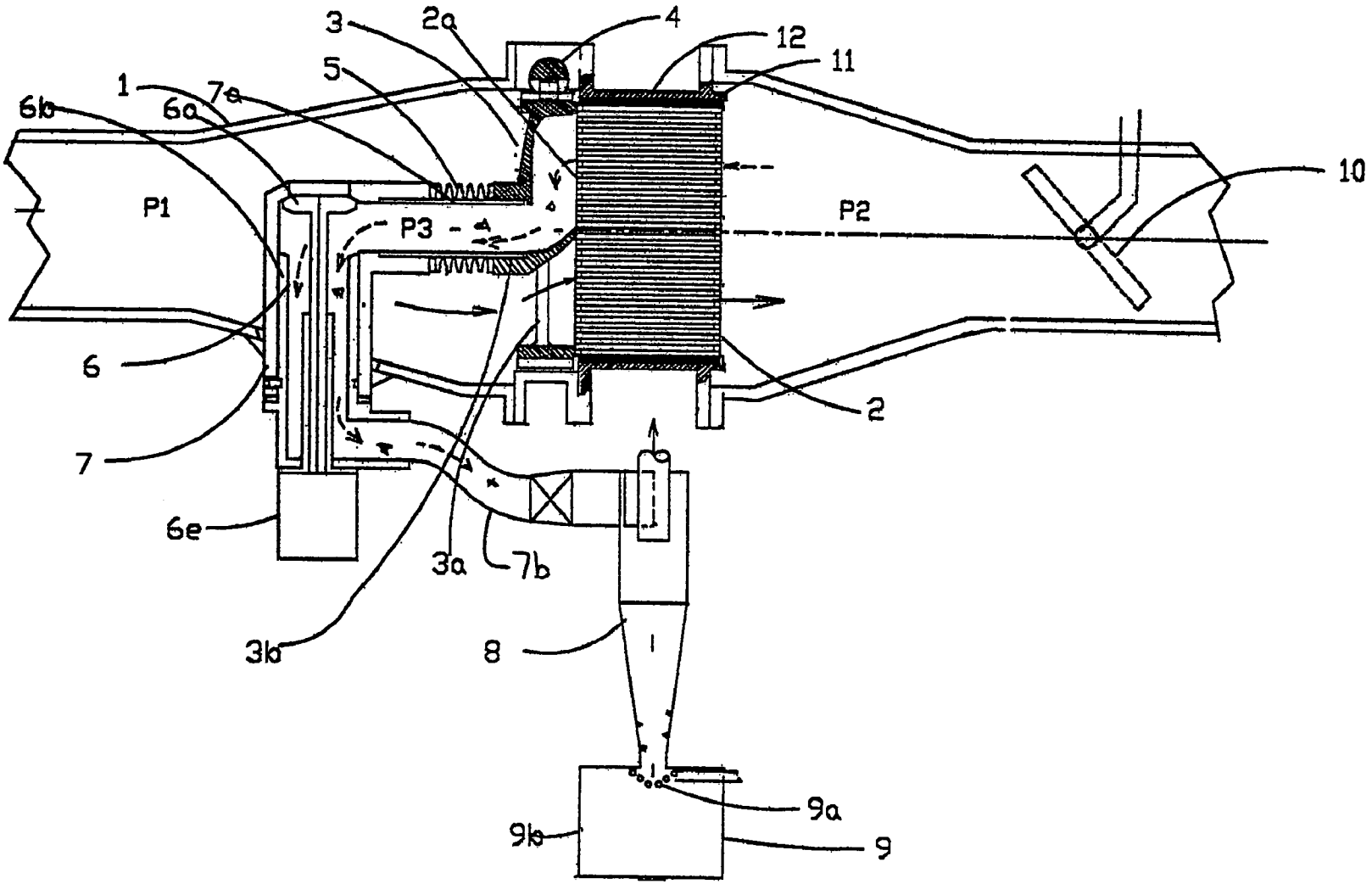
FIG. 6 is a sectional side view of the single trap configuration of the wall-flow particulate trap system in the regeneration mode of operation.

FIG. 6 shows the wall-flow particulate trap system in the regeneration mode. The first action taken by the particulate trap control system will be to energize a soot igniter coil 9*a* and actuate the remote actuated relief valve 10. The latter action will close the relief valve 10, restricting the flow of exhaust gas to the atmosphere until it has built up a pressure P2 to a level of at least 30 in. W.G. This pressure P2 will be maintained substantially constant, regardless of the engine speed or load changes. Once the pressure P2 has stabilized and the igniter coil 9*a* is at high temperature, the control system will energize a mode valve actuator 6*e*, and the actuator will move the mode valve 6*a* up to the position shown. This action will stop all flow of exhaust into the purge duct 7 and will open the purge duct 7 to a separator duct 7*b* leading to the separator 8. Because the purge duct 7 is at ambient pressure, a small flow will pass back through the passages 2*f* of the trap 2 circumscribed by the minor duct section 2*c* as a result of the 30 in. W.G. reverse pressure drop. As this reverse flow occurs the soot and/or ash cake will be dislodged and eroded, and the particles will be carried by the purge flow to the separator 8.

Because the passages being reversed cleaned at any instant comprise only a small fraction of the total wall-flow trap passages (e.g., 1/15 to 1/18 of the total), the escaping reverse flow will be easily replenished by the continuing forward flow through the major section 2*d* to provide filtered exhaust. This will permit the pressure P2 to be maintained at 30 in. W.G. under substantially all engine operating conditions. The minor duct section 2*c* and the pressure level P2 may be varied to accommodate different engine or performance requirements. The duct rotor 3 continues to slowly rotate to sequentially clean all of the trap passages 2*f* until all passages have been regenerated after one full revolution to the duct rotor 3.

In the depicted embodiment, the separator 8 is a cyclone separator. The purge flow which contains the dislodged particles of soot and/or ash will then pass through the cyclone separator 8 wherein the soot and/or ash particles will be moved by centrifugal force against the inner walls of the cyclone and the cleaned purge flow will pass upward through the central passage to the atmosphere. After being forced against the walls of the cyclone separator 8, the particles will migrate downward and pass through the igniter coils 9*a*, wherein the soot will be burned and the incombustible ash will fall into the ash storage chamber 9*b* for periodic removal during normal engine and/or vehicle servicing.

Following at least one complete revolution of the duct rotor 3, the particulate trap system control will deactivate the mode valve 6*a*, and the mode valve 6*a* will be returned by a spring (not shown) to the down position which will isolate the purge duct 7 from ambient conditions. Thereafter, the small flow of exhaust gas into the purge duct 7 will resume and continue through the collection of passages 2*f* for filtration. Then, the control will deactivate the igniter coil 9*a* and the relief valve 10 and return these components to their respective position for normal operation.

Figure 7:
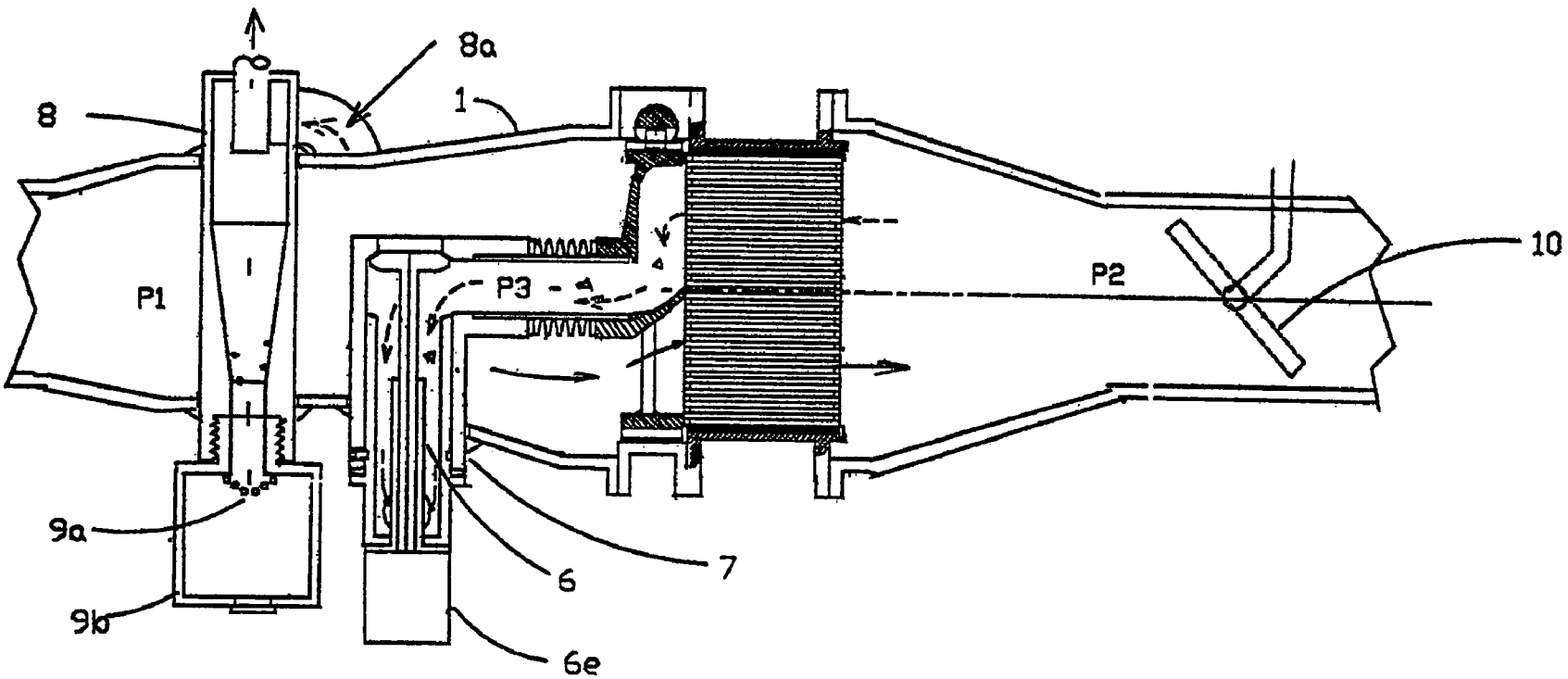
FIG. 7 is a sectional side view of the wall-flow particulate trap system in an alternative embodiment.

FIG. 7 illustrates, in regeneration mode, an embodiment for use with transit buses, school buses, automobiles and similar vehicles, in which an exhaust system and muffler are placed beneath the body of the vehicle and oriented in a generally horizontal direction. All of the components perform the same functions and the particulate trap system operates in the same manner as was described in conjunction with FIG. 5 and FIG. 6. The difference is that the cyclone separator 8, is transversely located through the center of the particulate trap structure 1, as shown. A tube 8*a* connects the mode valve assembly 6 with the inlet to the cyclone separator 8. In the depicted embodiment, the tube 8*a* has a helical twist. The soot igniter 9*a* and ash storage receptacle 9*b* are in a convenient location for periodic ash removal.

One advantage of this arrangement is that all components are part of the trap structure 1, permitting it to be a totally self contained device except for the control system (not shown) which would be placed in a cool location. An important functional advantage is that the cyclone separator 8 would be kept hot by the surrounding exhaust gas flow. This will minimize any condensation of the combustion generated moisture during normal operation. This could be a problem for vehicles operating in cold weather conditions.

In the embodiment depicted in FIG. 7, it should be noted that the rotor drive mechanism and other components of the trap assembly are positioned such that almost the entire periphery of the trap assembly is only slightly larger than the outer diameter of the particulate trap. Additionally, items such as the mode valve actuator and rotor drive are in alignment and positioned towards the bottom of the trap structure. This provides a very compact package that does not substantially increase the overall length of the particulate trap assembly. Accordingly, the embodiment depicted in FIG. 7 can be installed in vehicles where space is limited. As examples, the embodiment may be installed on transit buses, school buses, automobiles, and utility trucks. Moreover, because the present invention does not require heat for regeneration, the trap assembly does not have to be placed close to the engine and may be located in any convenient location, such as the position of the normal engine muffler.

Figure 8:
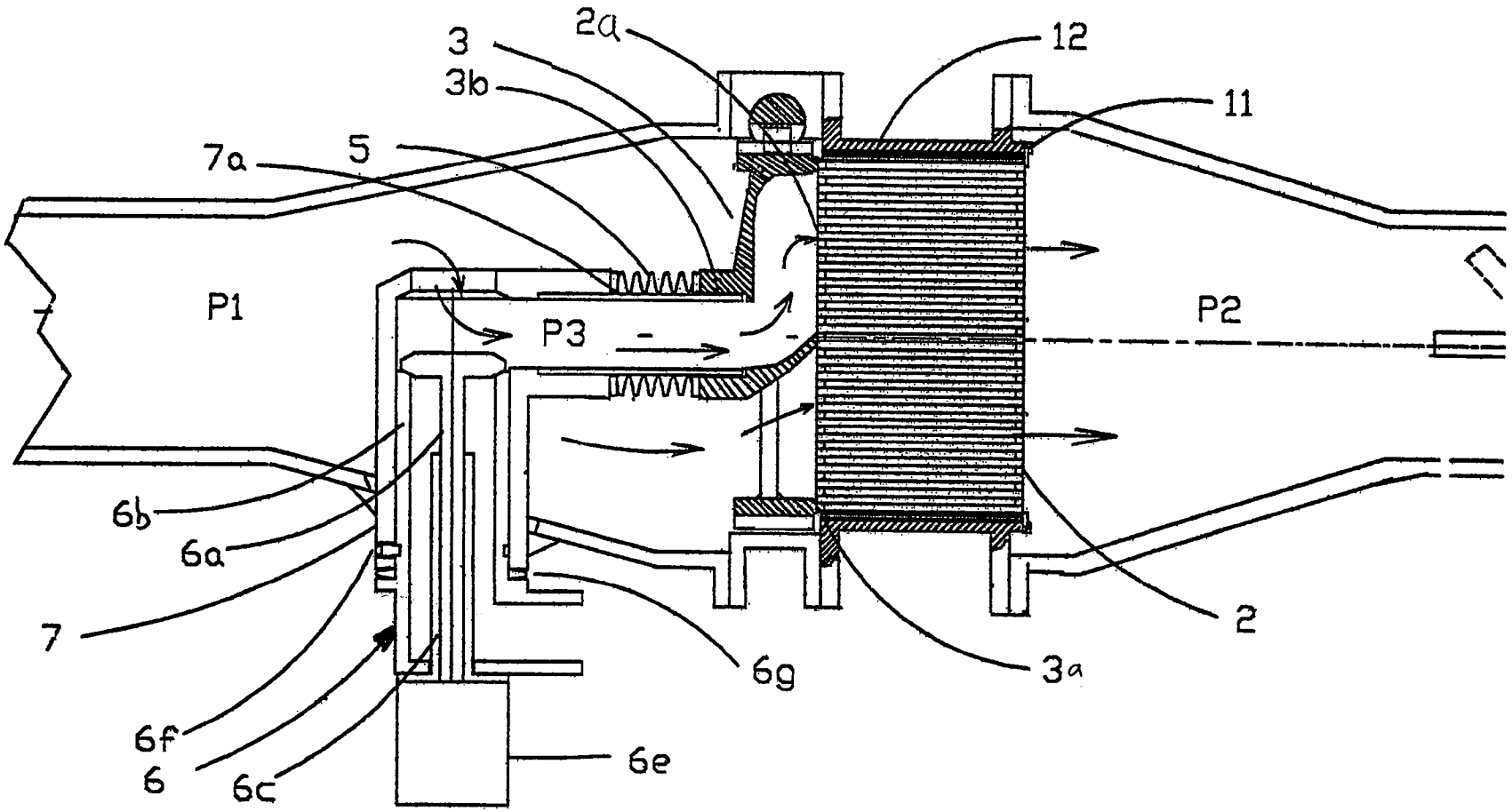
FIG. 8 is an enlarged sectional side view of a portion of FIG. 5 to show details of the duct rotor and wall-flow trap relationship and the mode valve assembly during normal filtration.

FIG. 8 is an enlarged view of the particulate trap system shown in trapping mode during normal engine operation to illustrate more clearly the operation of the duct rotor 3 and its role in controlling flow through the trap 2. This view will also show more clearly the design and operation of the mode valve assembly 6.

The particulate trap module 2 is located in a surrounding can 11. The particulate trap module is sealed and held in place by a layer 12 of Interam®. Interam® is a registered trademark of the Minnesota Mining and Manufacturing Co., DBA 3M Co., of St. Paul, Minn. This is a standard method of retaining the fragile ceramic wall-flow trap module. It will be noted that the trap 2 is positioned such that its exhaust gas inlet face, projects a small amount (about 0.050-0.1 inch) outside an inlet end of the can 11.

Following, or prior to, the installation of the trap module 2 in the can 11, the inlet face 2*a* of the trap module is ground and/or lapped to a very flat surface having a fine finish. The face 3*a* of the duct rotor 3, which is of the shape of the "foot print" that was shown in FIG. 5*b*, is also ground or lapped to be in a very flat plane and to also have a very fine finish. The trap 2 is assembled with the above two surfaces, 2*a* and 3*a*, held in contact with each other with a very low force such as by a bellows spring. As mentioned earlier, this force is just sufficient to assure that the duct rotor 3 does not separate from the trap face 2*a* during all engine operating conditions. As assembled, the outer ring of the "foot print" rests directly against the trap face 2*a* covering about a 0.1 inch radius of the trap face at the outer diameter of the trap module 2. The major and minor duct sections 2*c*, 2*d* pass across portions of the trap face 2*a* with a very close clearance. This results in the duct rotor outer ring covering the outer ring of passages of the trap module 2. With the larger 12 inch diameter trap modules, this results in about a 3.5% reduction in the open frontal area and, of course, in the trap capacity. This small loss in open frontal area and trap capacity is not considered serious because the trap 2 can be very easily and efficiently regenerated more often.

In some embodiments, a more uniform surface at the outer diameter of the trap where the rotor rests against the trap face (radially inward about 0.1 inches) is obtained by plugging all of the passages 2*f* located in this area. This plugging of the additional passages will not further reduce the trap open frontal area or its capacity because flow into these additional passages will, in any case, be prevented by the outer ring 3*c* of the duct rotor 3. The additional plugs are substantially the same as the plugs currently used in wall-flow traps.

The additional plugs are added during the process used to plug the alternate passages of current traps prior to final firing of the trap. Following the final firing, the trap inlet face 2*a* would be ground or lapped as previously discussed. The final ground trap face 2*a* would have the same pattern of open and plugged passages but these would be surrounded by a smooth solid ring against which the rotor outer ring 3*c* would rest. This would provide a continuous flat surface to minimize wear and gas leakage.

The purge duct 7 has an integral extended tube 7*a* around which the seal 5 is positioned and also serves as the inner journal for the second end of the rotor 3*b*. In the depicted embodiment, the seal 5 is a bellows spring. The mode valve assembly 6, which contains the valve 6*a*, auxiliary member 6*b*, valve guide 6*c*, and valve actuator 6*e*, is made as a sub-assembly and inserted into the purge duct 7. In the depicted embodiment, the mode valve assembly 6 is locked in place by a set-screw which locates in circumferential groove 6*f*. The purge duct 7 and mode valve assembly 6 may be manufactured as separate apparatus prior to assembly into the trap structure 1.

The valve 6*a* is held in the position shown in FIG. 8 by the actuator 6*e* and is moved down to seat on member 6*b* when the actuator 6*e* is electrically or pneumatically energized. In the depicted embodiment, the valve 6*a*, valve seat 6*b* and actuator 6*e* comprise a sub-assembly and can be removed from the purge duct 7 for repair or replacement. When assembled as part of the total mode valve assembly 6, the valve auxiliary member 6*b* is slid up into the purge duct 7, thereby compressing a seal 6*g*. In the depicted embodiment, a set screw is then entered into the circumferential groove around the auxiliary member 6*b*. Prior to final tightening of the set screw, the auxiliary member 6*b* is rotated to point the exit duct in the direction desired for piping to the separator 8.

When the particulate trap system is assembled, the seal 5 is piloted on the extension tube 7*a*, and then the duct rotor 3 is placed over the end of the extension tube 7*a* at the second end 3*b*. In the depicted embodiment, the seal 5 is a bellows spring that urges the duct rotor 3 toward the particulate trap 2. In operation, in the normal filtering mode, the duct rotor 3 will continuously slowly rotate at any time that the engine is in operation. Because pressures P1 and P3 are equal during the filtering mode of operation, there will be no leakage at the duct rotor 3 and the trap 2 interface. The very low force of the duct rotor 3 against the trap face 2*a* coupled with the very slow rotation speed should result in very long service life of the components.

Figure 9:
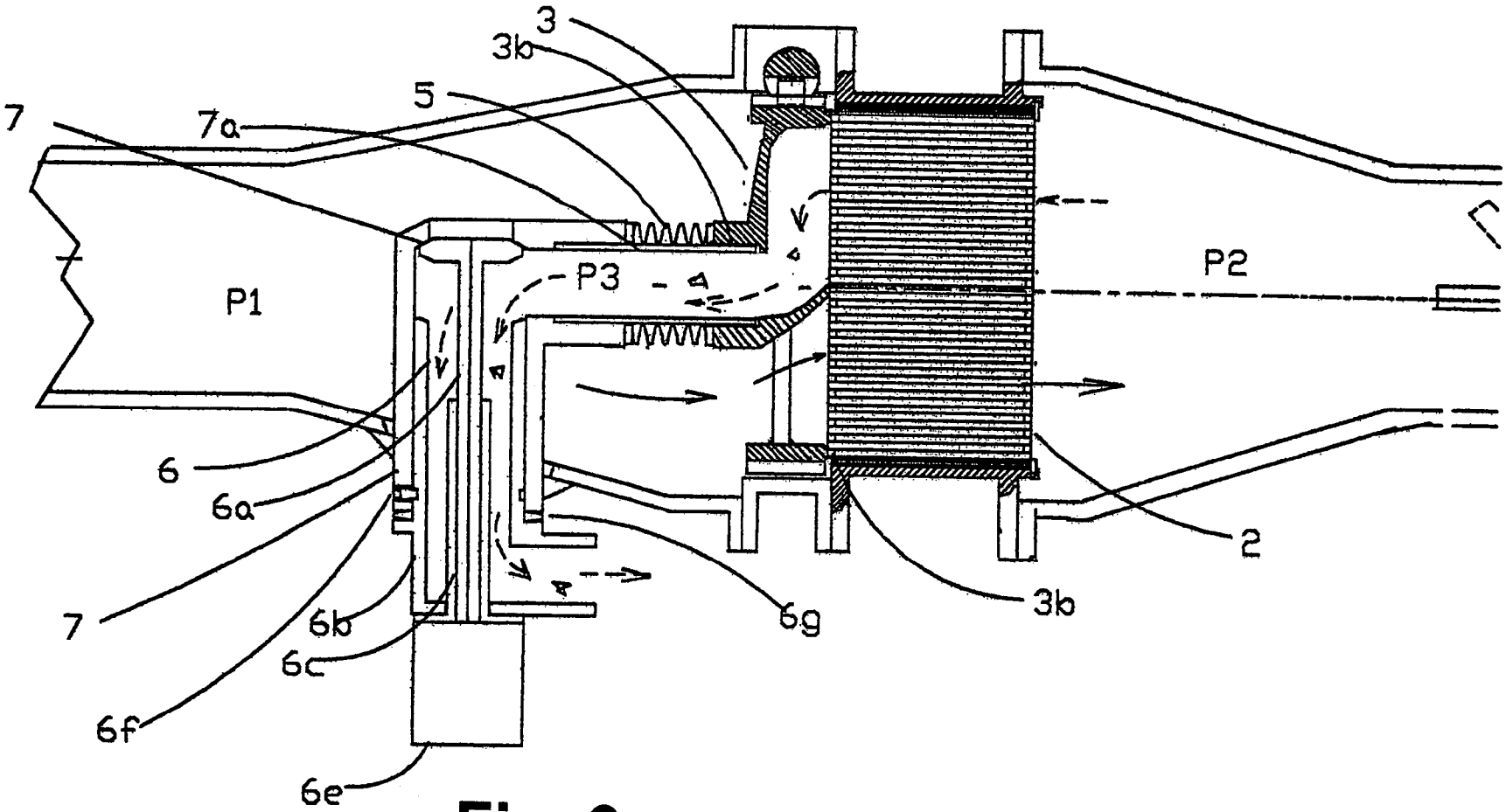
FIG. 9 is an enlarged sectional side view of a portion of FIG. 6 to show details of the duct rotor and wall-flow trap relationship and the mode valve assembly during regeneration.

FIG. 9 shows the same components as shown in FIG. 8 but are now changed to illustrate the regeneration mode. The remote actuated relief valve (not shown in this figure) has been actuated to maintain a pressure in the filtered exhaust gas at P2. In the depicted embodiment, P2 is about 30 in. W.G. or greater and which is held substantially constant, regardless of the engine operating conditions. The mode valve 6*a* has also been moved by the actuator 6*c* to the upper position to seat against the purge duct 7, thereby blocking off any further entry of exhaust gas into the purge duct. At the same time the mode valve 6 is lifted from the auxiliary member 6*b*, thereby opening the purge duct 7 to ambient pressure at P3. This permits a strong reverse flow of exhaust gas through the passages of trap 2 that are encompassed by the duct of the duct rotor 3 dislodging and eroding the soot and ash and carrying the particles to the separator and igniter (not shown).

When in the regeneration mode, pressure P1 will be 50-60 in. W.G., significantly greater than the near 0 in. W.G. pressure P3 in the purge duct 7. Under these conditions, there will be an additional axial force against the duct portion of the duct rotor 3 of about 12-15 pounds. This small additional force will tend to close the clearance between the duct rotor 3 and the trap face 2*a*, enhancing the seal effectiveness between the duct rotor 3 and the trap face 2*a*.

Figure 10:
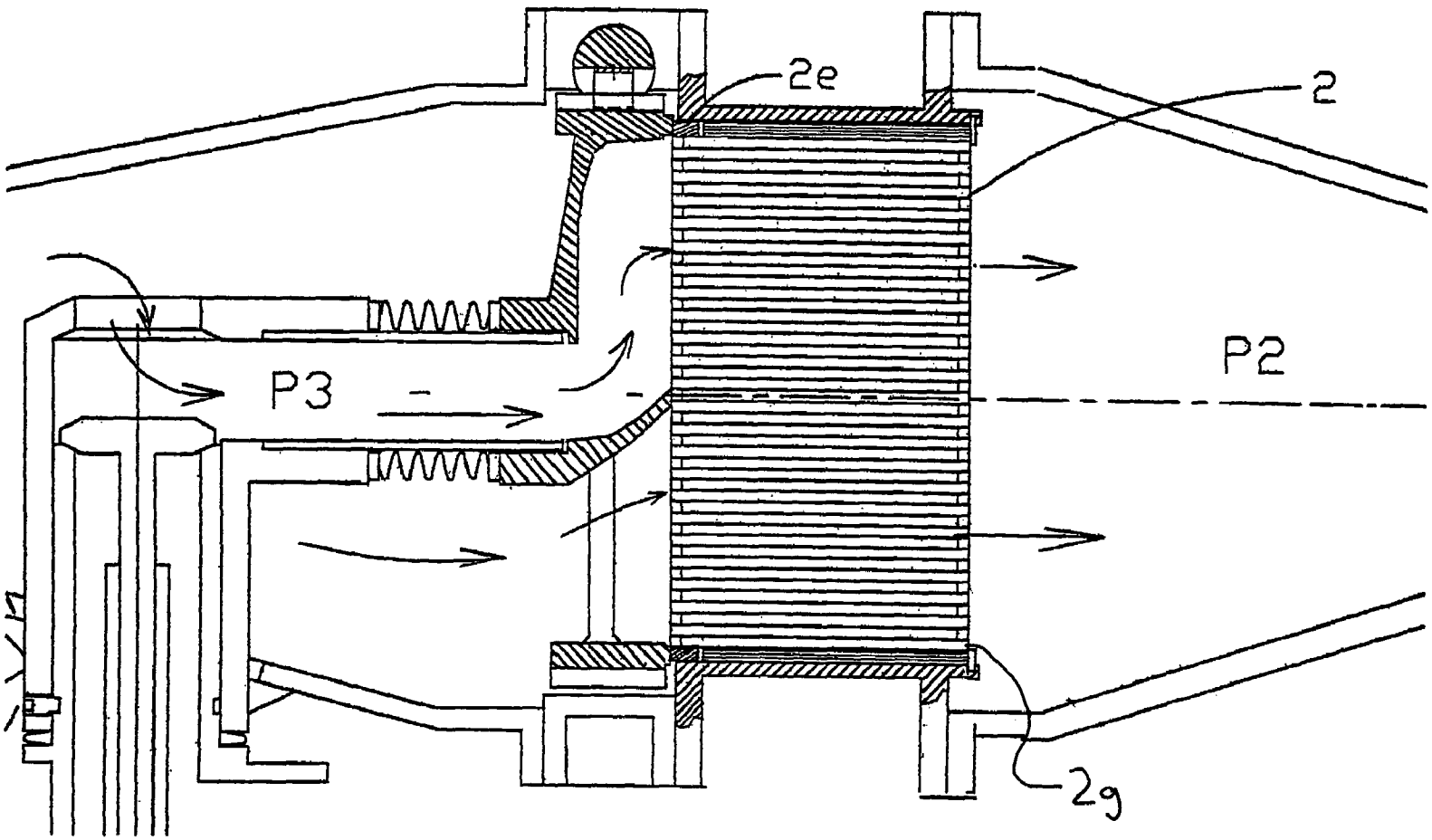
FIG. 10 illustrates an alternative duct rotor and wall-flow trap relationship in which a modified wall-flow trap can be used to increase the contact area between the rotary duct rotor and wall-flow trap and the open frontal area of the wall-flow trap.

FIG. 10 illustrates an alternative embodiment of the duct rotor 3 and the trap 2 interface that provides a larger and more uniform wear surface on the trap and precludes any loss of trap capacity caused by the duct rotor 3 outer ring. In this embodiment, the trap 2 is modified slightly during the trap module manufacture and the outer ring 3*c* of the duct rotor 3 will have a slightly larger diameter.

Following extrusion of the trap module core, a small cuff 2*e* shown cross hatched is formed at the periphery of the entrance face of the trap 2. In the depicted embodiment, this cuff 2*e* is about 0.125 inch in radial thickness and about 0.250 to 0.50 inch wide. It is applied to the extruded, but not yet fired, trap core by molding or wrapping the trap core with "green" cordierite tape of the required width to achieve the desired 0.125 inch thickness. The trap module is then fired in the normal manner, thereby bonding the cordierite cuff to unfired trap module in the process. Outer trap module passages 2*g* are then plugged in the conventional manner to form the complete wall-flow trap with the added cordierite cuff. The cuff 2*e* might be made of a separate refractory material provided that it will have the same or similar properties, such as coefficient of expansion, wear characteristics and bond qualities.

Following the above modifications, the trap face 2*a*, including the cuff 2*e*, will be ground and/or lapped to provide the desired flat wear surface. It will be noted from FIG. 10 that with this alternative design, the duct rotor 3 does not block off any of the outer passages 2*g*. In addition, the cuff 2*e* will provide additional mechanical strength to the particulate trap 2.

Figure 11:
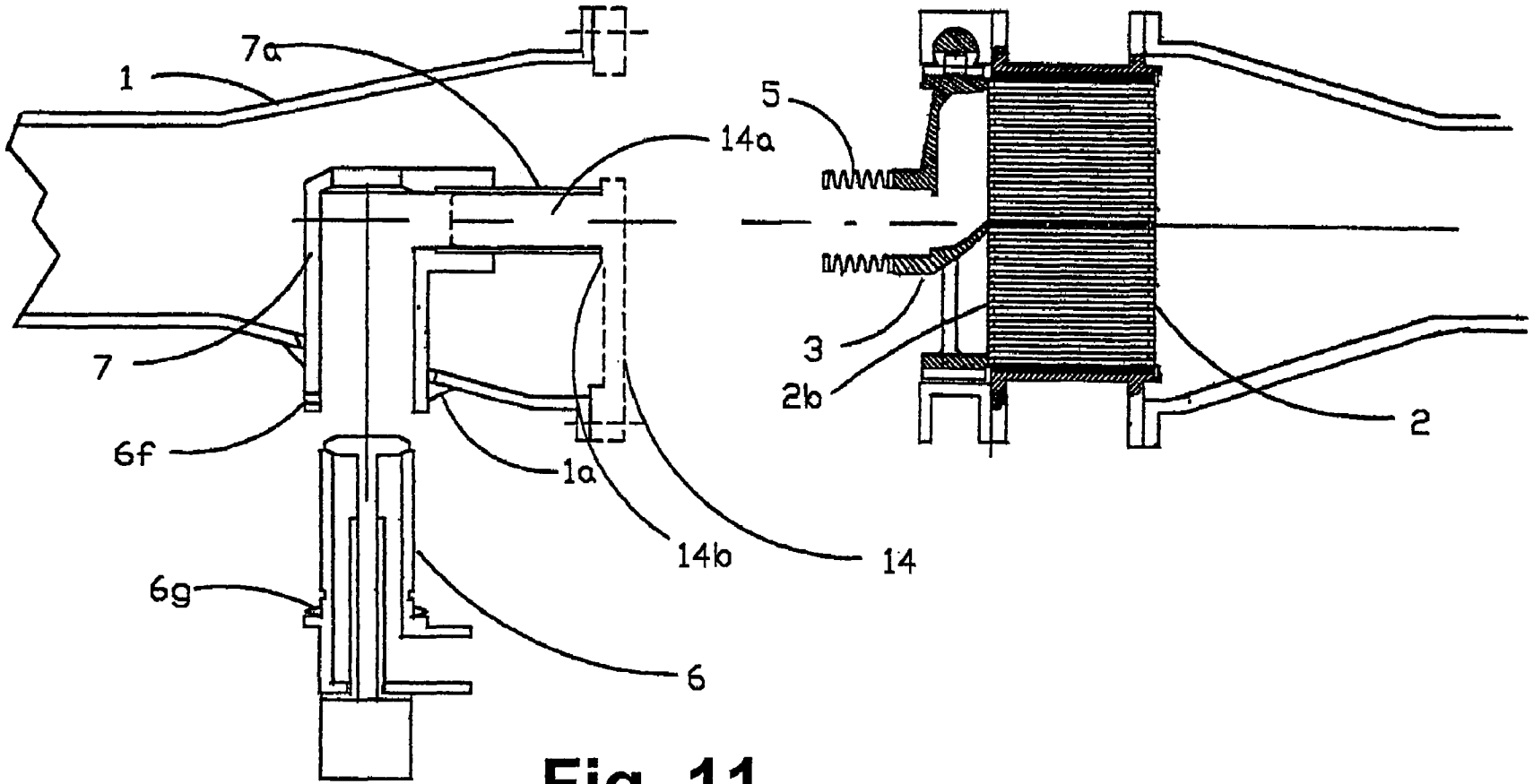
FIG. 11 is an exploded view of the particulate trap system illustrating a method of assembling the previously manufactured purge duct and mode valve assembly and other components of the particulate trap system.

FIG. 11 is an exploded view of the particulate trap 2, the duct rotor 3, the purge duct 7, the seal 5, and the mode valve assembly 6. FIG. 11 illustrates a suggested method of assembly of the components. This will permit the pre-manufactured components to be assembled in very accurate relationship with each other without any further machining of the trap assembly.

The purge duct 7 is first slipped into a slightly enlarged hole 1*a* of the trap structure 1. An extended pin 14*a* of an assembly fixture 14 is then inserted into the extension tube 7*a* of the purge duct 7, and then the assembly fixture 14 is bolted to the structure 1, as shown. The purge duct 7 is then pulled up against a face 14*b* of the assembly fixture 14. The purge duct 7 is then roughly centered in the hole 1*a*, and the purge duct then welded or otherwise fixed in place as an integral part of structure 1. The assembly fixture 14 is then removed. The seal 5 and the duct rotor 3 are then fitted over tubular member 7*a* followed by assembly of the rest of the parts to structure 1. This procedure assures that the duct/valve rotor 3 is perfectly positioned in the radial and longitudinal directions and that its centerline is parallel to that of the trap structure 1. As assembled, the fit between the duct rotor 3 and the tubular member 7*a* will be made fairly large. This will locate the duct rotor 3 in a radial position with sufficient accuracy but also will assure that the duct rotor 3 will lie flat against face 2*b* of the trap at all times.

Figure 12A:
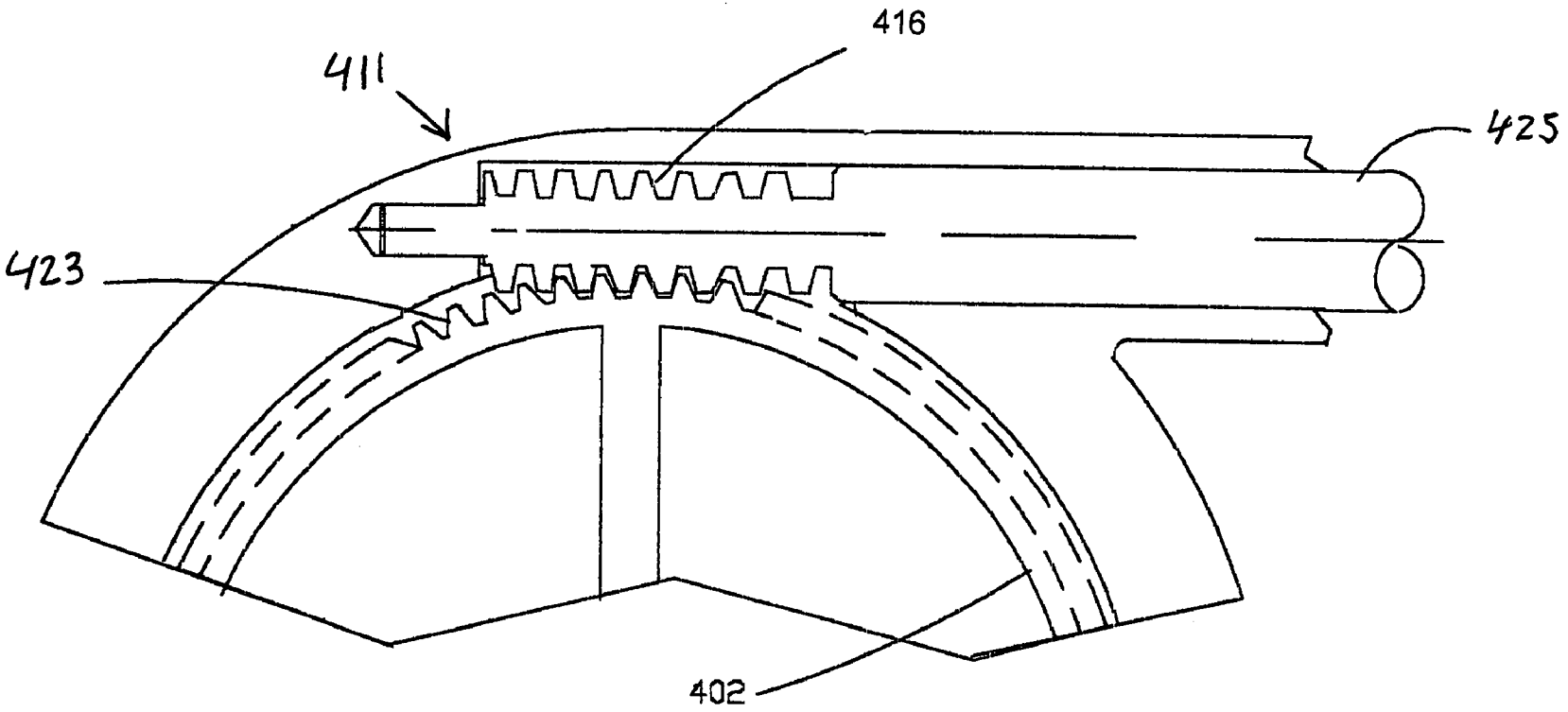
FIG. 12A is a sectional side view of the rotor drive in a first embodiment.

FIG. 12A illustrates the rotor drive 4 as a worm gear set, generally indicated by numeral reference 411. The worm gear set 411 includes a worm 416 and a driven gear 423. The worm 416 is operatively connected to a shaft 425. In the depicted embodiment, the worm 416 forms part of the shaft 425.

Figure 12B:
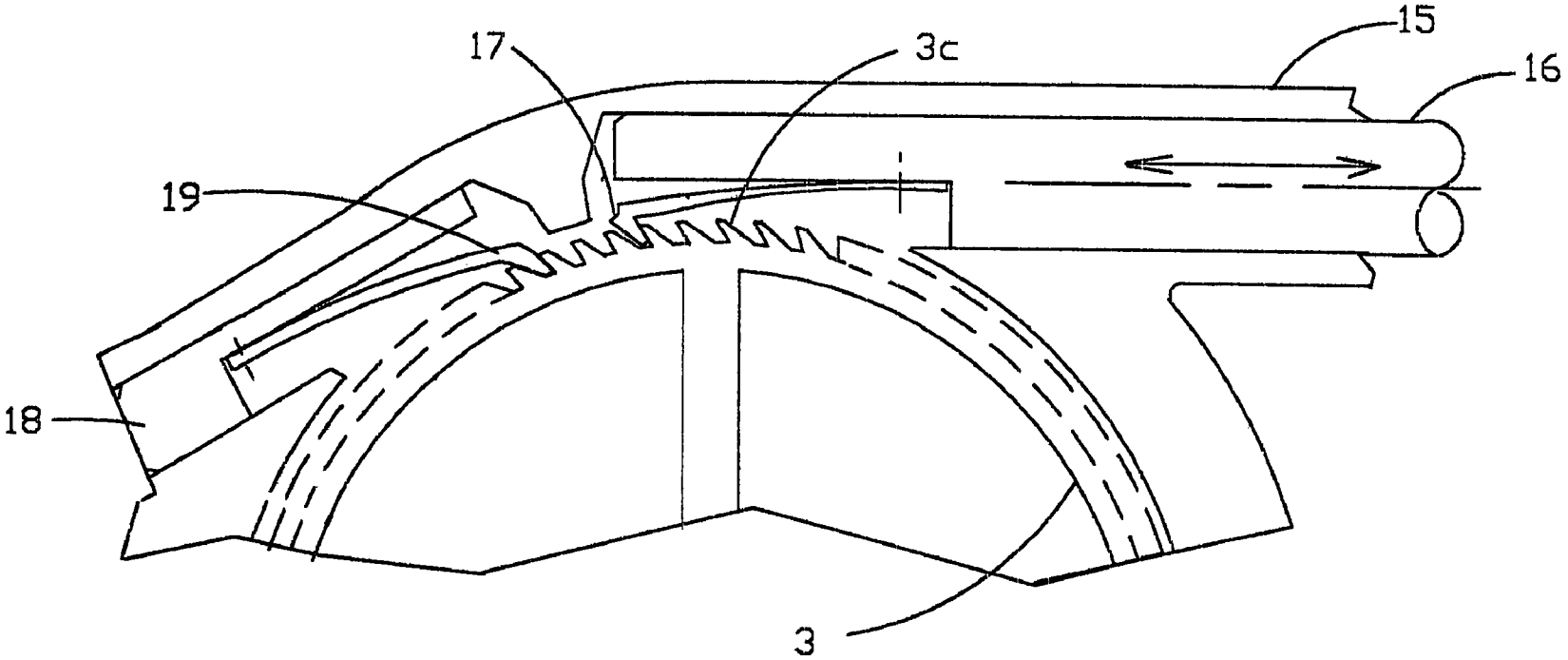
FIG. 12B is a sectional side view of the rotor drive in a second embodiment.

FIG. 12B illustrates the rotor drive 4 as a ratchet drive arrangement, shown generally at 15, used to drive the duct rotor 3. The component parts include a linear actuator (not shown), actuator shaft 16, a pawl and spring 17, which is attached to the actuator shaft 16, a detent stationary shaft 18, and a detent pawl and spring 19, which is attached to the detent shaft 18. The pawl 17 and the spring pawl 19 each engage the outer ring 3*c* on the periphery of duct rotor 3. For example, the outer ring 3*c* may include ratchet teeth. The pawls 17, 19 are each made of a material that will maintain its physical properties under high temperature conditions.

In operation, the actuator shaft is moved to the right in the drawing, thus pulling the duct rotor 3 clockwise. At the same time, the detent spring pawl 19 is lifted and then drops into position at the next tooth, thus preventing any reverse rotation as the actuator shaft moves to left to engage another tooth. In the depicted embodiment, the actuator is of the electromagnetic type; however, pneumatic or other means could be used. Rotation can be carried out one tooth at a time, thus providing a substantially constant rotational speed. Alternatively, the stroke of the actuator could be perhaps an inch or more to quickly expose a large number of trap passages. The actuator may receive its energy from a pulse generator 31 (best seen in FIG. 14A).

A major advantage of the use of the ratchet drive for duct rotor 3 is that it permits a large change in diameter of the duct rotor 3, which may result from temperature changes, without adversely affecting the effectiveness or life of the ratchet drive. In addition, there is little or no relative movement between the pawls 17, 19 and the ratchet teeth during actuation which might otherwise adversely affect the life of these components. Finally, the ratchet drive responds to electrical pulses, which is ideal for flexibility of the speed control.

Figures 13A, 13B:
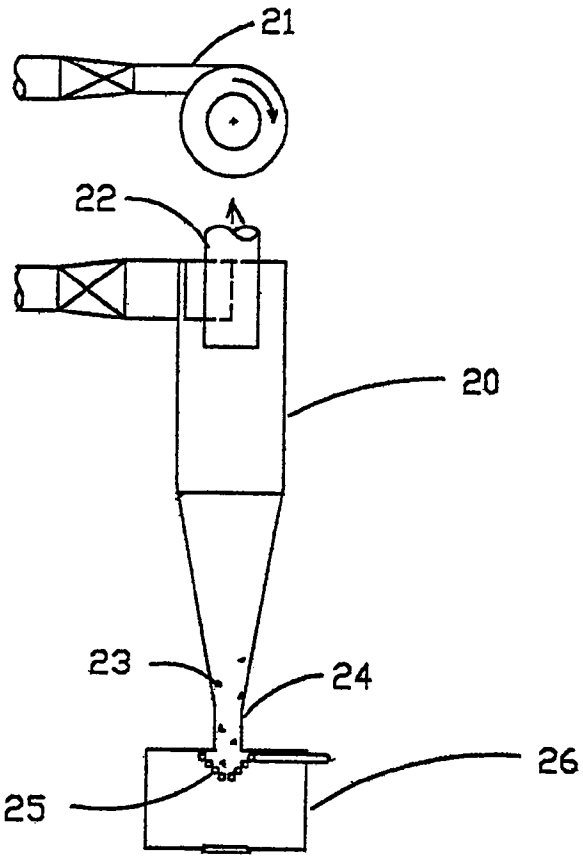
FIG. 13A is a side view of a separator and igniter assembly including the igniter coil and the ash storage receptacle.
FIG. 13B is a top view of the separator shown in FIG. 13A.

FIGS. 13A and 13B illustrate the separator, igniter and ash storage receptacle in more detail. In the depicted embodiment, the separator 20 is a cyclone separator. The cyclone separator 20 may be a standard device and the relative dimensions in the drawing are based on information obtained from *Unit Operations of Chemical Engineers*, by McCable et al, Fourth Edition, McGraw Hill International Editions (1985). The purge flow is arranged to enter substantially tangentially through a ½×2 inch passage 21 at a velocity of about 50 feet per second. The flow then spirals downward, centrifugally deposits the particles on the inside surface of the cyclone and the cleaned purge flow then exits upwardly through a thimble 22 to the atmosphere. The separated particles 23 in most applications gravitate downward and exit at an end 24 of the cyclone into a suitable storage container. In this application, the particles 23 after gravitating downward are caused to pass through high temperature igniter coils 25 whereby the soot is ignited and burned on contact. The incombustible ash is then deposited in an ash storage receptacle 26.

The cyclone separator has the advantage of being very simple with no moving parts and is capable of very high temperature operation. The disadvantage of the simple cyclone separator for many applications is that it is very sensitive to changes in flow rate. In the depicted embodiment, the purge flow rate is determined by the 30 in. W.G. reverse differential pressure and the number of trap passages under going regeneration at any given time. Because the above values are substantially constant regardless of the engine speed and load, the cyclone can be sized to provide the most effective separation of the soot and ash for any given particulate trap system.

As stated previously, the particulate trap system does not have to be heated to achieve regeneration and the regeneration process is not affected by the engine speed and load.

These factors permit the use of a very simple particulate control system that is entirely separate from the engine and its control system.

Figures 14A, 14B:
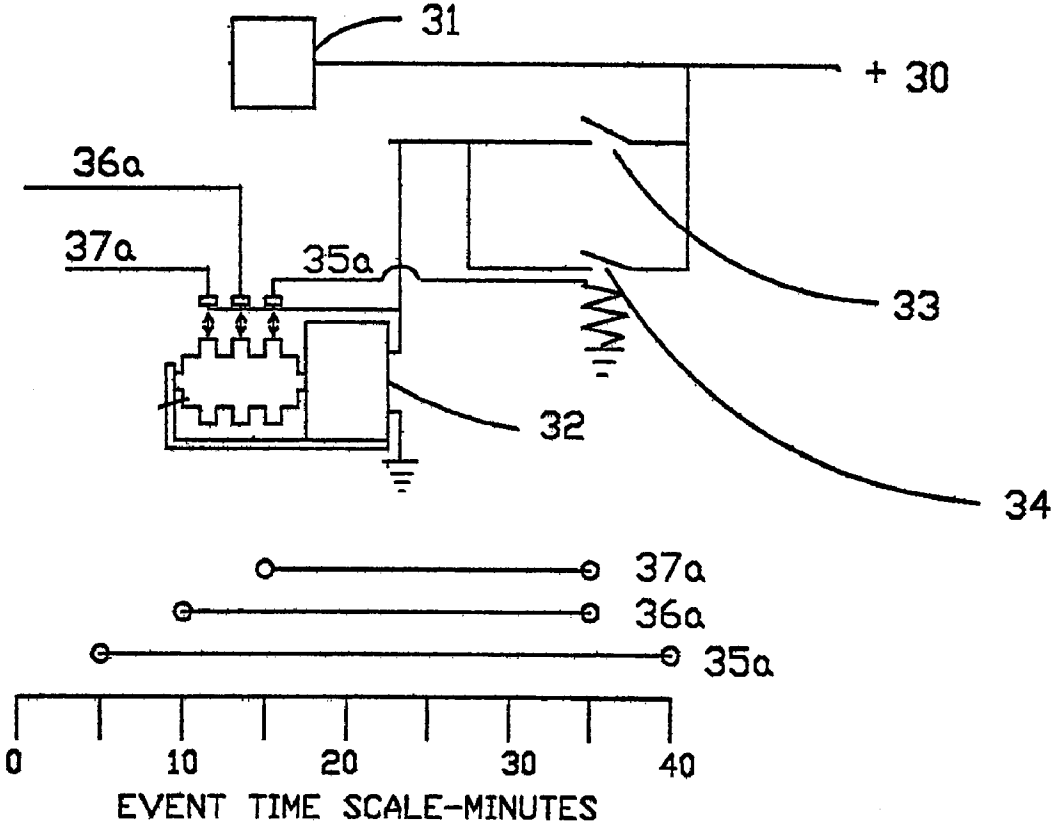
FIG. 14A is a schematic drawing of a dedicated particulate trap system control in which regeneration is initiated at a desired differential pressure across the wall-flow particulate trap.
FIG. 14B is an event time scale illustrating the operating times of the components illustrated in FIG. 14A.

FIG. 14A illustrates a control that will cause regeneration to occur when the pressure drop across the trap reaches a level, 20 in. W.G. as a selected example, although any desired pressure drop could be used. The parts consist of a power bus 30, a pulse generator 31, a timer motor 32, a P1-P2 pressure switch 33, a relay switch 34, and toggle switches 35, 36, and 37. The toggle switches 35-37 are closed and opened as a function of the rotation of the timer motor 32. The toggle switches 35-37 energize or de-energize corresponding circuits 35*a*, 36*a* and 37*a*. FIG. 14B illustrates an Event Time Scale, which is the timing of these switch events in minutes. It is emphasized that these values can be changed as desired.

In the depicted embodiment, electrical power is supplied at all times that the engine is in operation. It can be seen that the pulse generator 31 is therefore in operation when the engine is running. The pulse generator 31 is very similar in function and operation to an automobile turn signal timer. The pulse generator 31 is electrically connected to the rotor drive 4.

When the pressure drop across the particulate trap reaches 20 in. W.G. or greater, P1-P2 momentary pressure switch 33 will close and initiate operation of the timer motor 32. This switch action may not be continuous but after it has been closed for a total time of five minutes, the timer will have rotated to close toggle switch 35, thus energizing circuit 35*a*, thereby closing relay switch 34, and thereby initiating constant rotation of the timer motor 32. After the timer motor 32 operates for five minutes, the switch 36 will close energizing circuit 36*a*, which will actuate the remote actuated valve 10, and the soot igniter coil 9*a*. After another five minutes of operation, the timer will close the switch 37, activating circuit 37*a*, which will energize the mode control valve 6 (not shown) and reverse flow regeneration will be initiated. This will continue for 20 minutes during which time the duct rotor 3 will have made 1 ¼ revolutions (at a speed of four revolutions per hour). Following this time period, the switches 36 and 37 will open de-energizing circuits 36*a* and 37*a* and returning the particulate trap operation back to normal filtration operation. The timer motor 32 will continue to operate for another five minutes at which time switch 35 will re-open, de-energizing circuit 35*a*. This will, in turn, again open relay switch 34, and stop the rotation of the timer motor 32. Normal operation of the particulate trap system will continue until the pressure drop across the particulate trap again reaches 20 in. W.G.

Although this is a very simple control, it is assumed that the entire control, with possible exception of the P1-P2 pressure switch 33 can be designed as a solid state module for smaller size, lower cost and greater reliability.

Figures 15A, 15B:
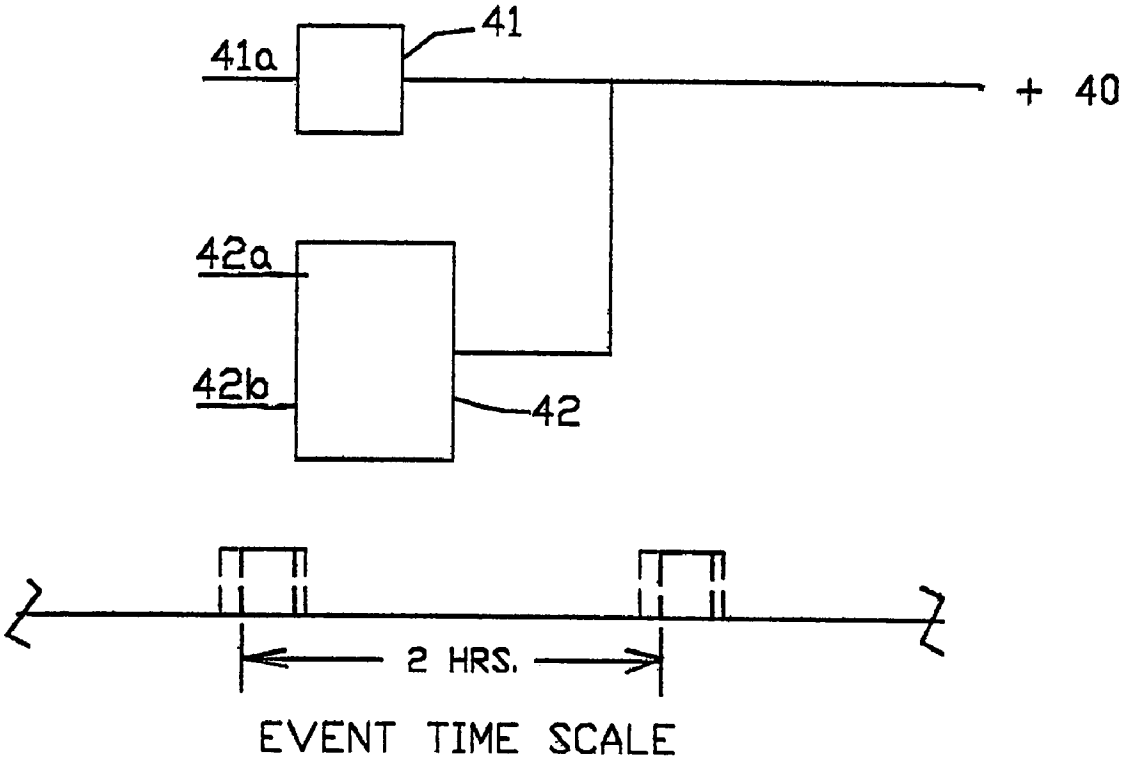
FIG. 15A is a schematic drawing of an alternative dedicated particulate trap system control in which regeneration is initiated after a desired period of engine operation.
FIG. 15B is an event time scale illustrating the operating time of the components illustrated in FIG. 15A.

FIG. 15A illustrates an even simpler particulate control that operates entirely separate from the engine and its control. In this control, only a timer motor or other device is used that is arranged to operate switches that are not shown in the drawing. The Event Time Scale for the device is shown in FIG. 15B.

The major parts are a power input bus 40, a pulse generator 41, a timer 42, and circuits 41*a*, 42*a* and 42*b*. The input bus 40 is energized at all times that the engine is in operation. Consequently, the pulse generator 41 is also in operation when the engine is operating and this, through circuit 41*a*, causes the duct rotor 3 to continuously rotate at a speed of four to six revolutions per hour.

Energy is also supplied to the timer 42 at all times that the engine is in operation. This causes the regeneration events to occur as simply a function of time. In the depicted example, it has been decided that regeneration is to occur every two hours regardless of the engine speed and load history during this time. The time between regeneration events would be selected based on a "worst case scenario for engine particulate emissions" to assure that regeneration occurred prior to unsafe loading (e.g., >6-10 g/l) of the particulate trap. When it is time to regenerate the trap, the timer 42 will first energize circuit 42*a*, as shown in the Event Time Scale, to activate the remote actuated relief valve 10 and the soot igniter coil 9*a*. After about five minutes of continued operation, the timer 42 will energize circuit 42*b*, as shown in the Event Time Scale, which will energize the mode valve actuator 6*a* and initiate regeneration. After about twenty minutes and until the duct rotor has turned about 1 ¼ revolutions circuits 42*a* and 42*b* will be de-energized and the particulate trap will return to normal operation.

Figures 16A, 16B:
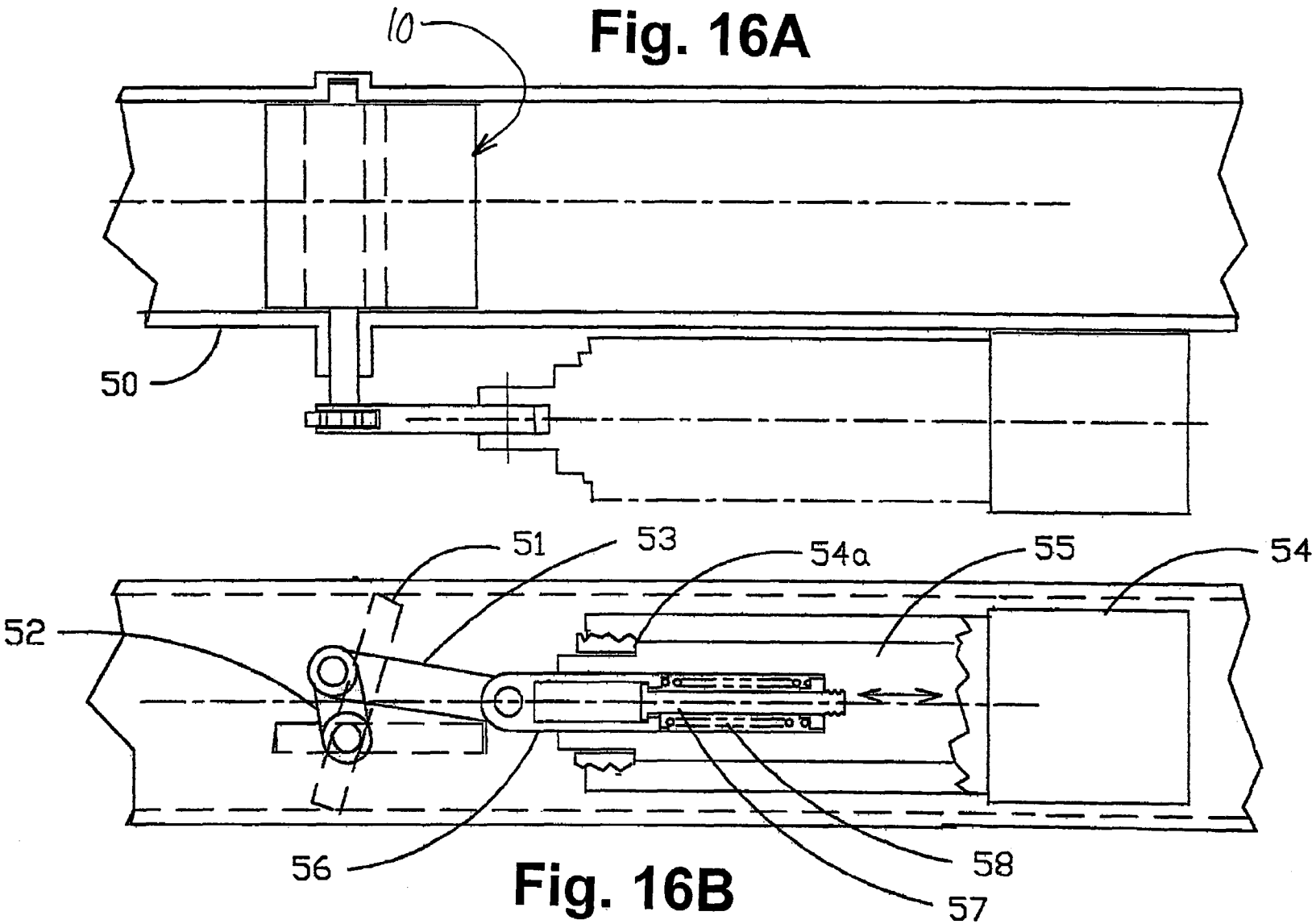
FIG. 16A is a partial sectional top view of a first embodiment of the remote actuated relief valve.
FIG. 16B is a partial sectional side view of the embodiment shown in FIG. 16A.

FIGS. 16A and 16B illustrate a first embodiment of the remote actuated relief valve 10. The components consist of a section of exhaust pipe having a rectangular cross section 50, a rectangular butterfly valve with an off-center pivot shaft 51, a butterfly actuation lever 52, connecting link 53, an electromagnetic or pneumatic actuator 54, and an actuator ram member 55. The actuator ram member 55 contains a reciprocal slip link member 56, which is pressed to the left (in the drawing) to normally rest against a stop screw 57 by a low rate spring 58. When the actuator 54 is de-energized the actuator ram member 55 is spring loaded to the right (in the drawing) against a stop (spring and stop members not shown).

When the control device determines the remote actuated relief valve 10 should be actuated, the electromagnetic actuator pushes the actuator ram 55 to the left (in the drawing) and remains in position against a stop member 54*a*. As a result of this action, the preloaded reciprocal slip link member 56 pushes the connecting link 53, which by way of butterfly actuation lever 52, and link 53 rotates the rectangular butterfly valve 51 to the closed position. This action immediately increases the pressure drop across the butterfly valve 51 and the pressure, acting on the unequal areas of the butterfly on each side of the pivot shaft, imparts a clockwise torque on the butterfly shaft. This torque is reflected by the linkages as force against the slip link member 56 (to the right in the drawing). When the pressure drop is 30 in. W.G. or greater, the force against slip link 56 will be great enough to overcome the preload of the low rate spring 58, and the slip link 56 will move to the right thus opening the rectangular butterfly valve 51. The spring rate of the low rate spring 58 coupled with the kinematics of the connecting links will be selected to assure that the pressure drop across the butterfly valve 51 will not exceed 40 or 50 in. W.G. It is emphasized that the amount of increased pressure P2 used for the reverse flow regeneration is not very critical. The pressure simply must be sufficient to dislodge and erode the soot and/or ash cake. The maximum pressure P2 is important only insofar as it affects engine performance during the regeneration events.

Figures 17A, 17B:
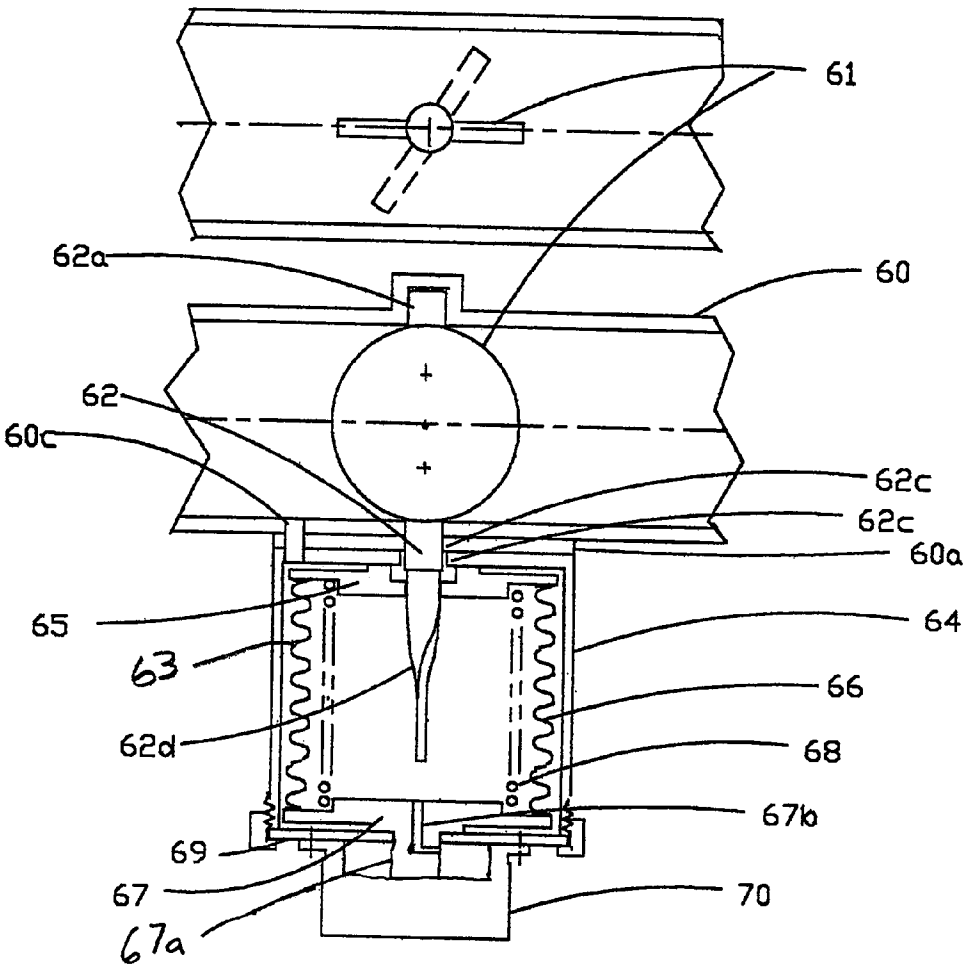
FIG. 17A is a partial sectional side view of an alternative embodiment of the remote actuated relief valve.
FIG. 17B is a partial sectional top view of the embodiment shown in FIG. 17A.

FIGS. 17A and 17B illustrate a second embodiment of the remote actuated relief valve 10. This configuration uses a more conventional cylindrical length of exhaust pipe 60 and a substantially circular butterfly valve 61 in which the actuation shaft 62 passes through its center. The actuation shaft 62 is piloted on one end is bearing 62*a*. The other end of shaft 62 is piloted with close clearance at the wall 62*b* of the exhaust pipe and at 62*c* of a flat steel member 60*a* that is brazed or welded to the cylindrical exhaust pipe 60 to provide a support surface for the remote actuated relief valve assembly. The butterfly actuation shaft 62 continues on and passes through hole 64*a* in a stationary housing 64. The shaft 62 then enters the bellows diaphragm assembly shown generally at 63 which is located within the stationary housing 64. The shaft 62 terminates in a length 62*d* at which the shaft 62 has been machined to provide a rectangular cross section of ⅛ inch×⅜ inch and which has been twisted through 90 degrees to form about a ¾ inch long helical length, as shown. The helical length of butterfly shaft 62*d* engages with close clearance a ⅛ inch×⅜ inch female rectangular slot 65*a* in the upper diaphragm plate 65. The upper diaphragm plate 65 is firmly attached with a hermetic seal to an upper end of a bellows diaphragm 66. In similar manner, a lower end of the bellows diaphragm 66 is firmly attached with a hermetic seal to a lower diaphragm plate 67. Pre-loaded (pre-compressed) low spring-rate calibration spring 68 is placed inside the bellows diaphragm 66 and piloted on both the upper diaphragm plate 65 and the lower diaphragm plate 67. The lower diaphragm plate 67 has an integral shaft 67*a* that passes with close clearance through passage 69*a* in the removable lower cover plate 69 for stationary housing 64. To permit any small leakage that passes between shaft 62*d* and slot 65*a*, the shaft 67*a* includes a small vent. The vent 67*b* also assures that the pressure within the bellows diaphragm assembly 63 remains at ambient pressure at all times. The portion of shaft 67*a* that passes out of the stationary housing 64 is attached to a rotary solenoid actuator 70 that is normally spring-loaded against a stop (not shown) but when energized will rotate through about 90 degrees before being arrested by another stop (not shown).

In normal engine operation, the rotary solenoid actuator 70 will be spring-loaded against its stop. This action will have rotated the bellows diaphragm assembly 63, clockwise (viewed from the bottom) against a stop and placed the butterfly valve 61 in the wide open position, as shown. When the control system decides that remote actuated relief valve 10 should be actuated, the rotary solenoid will rotate the bellows diaphragm assembly 63 counter clockwise (viewed from the bottom) about 90 degrees and close the butterfly valve 61 completely. When this occurs, exhaust flow through the cylindrical exhaust pipe 60 will be prevented thus immediately increasing the pressure drop across the butterfly valve 61. This action will cause flow to occur through passage 60*c* from the exhaust pipe 60 and into a space 71 between the bellows diaphragm assembly 63 and the stationary housing 64. This flow will immediately begin to build up a pressure in the space 71 which will act to force upper diaphragm plate 65 down against the bellows and calibration spring 68. When this pressure has built up to about 30 in. W.G., the preload of the spring 68 and the bellows diaphragm 66 will be exceeded and the upper diaphragm plate 65 will move downward against the combined spring rate of the above members 65 and 68. This downward movement of the slot 65*a* against the helical configuration of length 62*d* will cause the butterfly shaft 62 to rotate clockwise (viewed from the bottom), thus opening the butterfly valve. This action will continue until the pressure upstream of the butterfly valve reaches about 40 in. W.G. Depending upon changes in the speed and load of the engine, the diaphragm assembly 63 will open or close continuously to keep the pressure within the above limits. It should be noted that there will be very little torque imparted to the butterfly shaft 62 due to pressure drop across the valve because the area of the butterfly valve are equal on each side of the shaft.

When regeneration is completed and the control device signals that the particulate trap system should return to normal operation, the rotary solenoid 70 will be deactivated and the spring will rotate it clockwise against the stop and, by means of the bellows diaphragm assembly 63, again fully open the butterfly valve 61, and exhaust pressures will return to normal. It should be noted that the bellows diaphragm 66 and spring 68 have a very low spring rate when compressed axially. However, the bellows diaphragm 66 is very stiff in torsion.

Figure 18B:
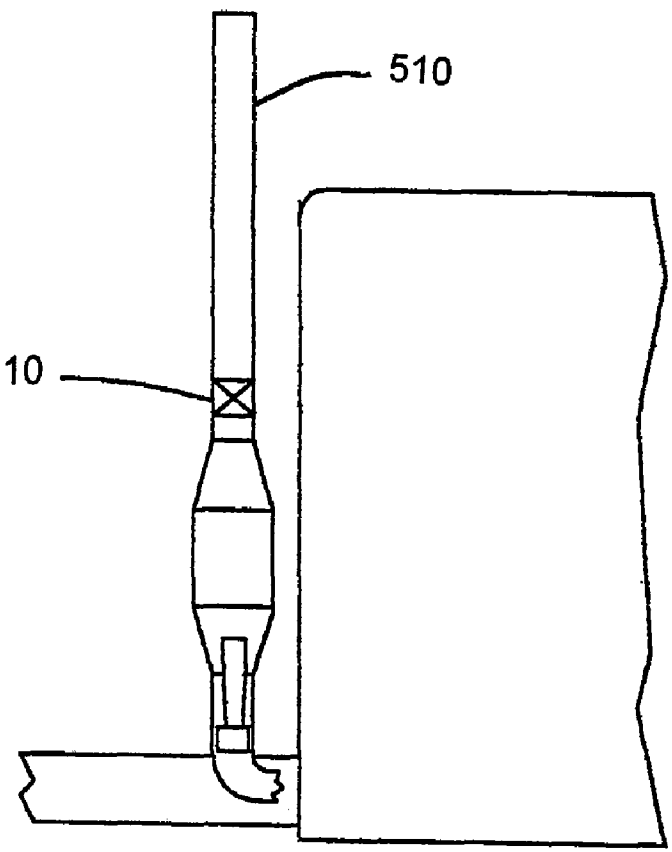
FIG. 18B illustrates a side view of the single trap wall-flow particulate trap system as installed on the highway truck shown in FIG. 18A.
Figure 18A:
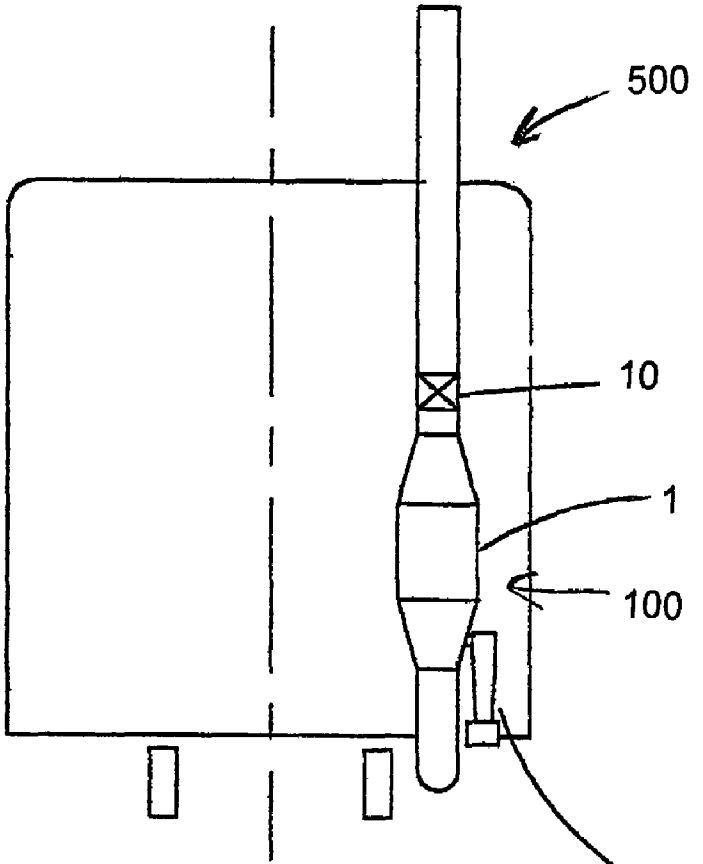
FIG. 18A illustrates a rear view of the single trap wall-flow particulate trap system as installed on a highway truck.

FIGS. 18A and 18B illustrate the particulate trap system 100 as installed on a highway vehicle 500. The vehicle 500 includes an exhaust system 510. As it can be seen, the exhaust system 510 and the particulate trap structure 1 are oriented in a generally vertical direction. It will be noted that the cyclone separator 8, soot igniter and ash receptacle 9 are independent of the particulate trap system structure 1. This is done to permit the cyclone separator 8 to be mounted parallel with the particulate trap structure 1 and to permit gravity to assist in the transfer of the separated soot and ash particles to the igniter and ash receptacle. In some embodiments, insulation is placed around the particulate trap structure 1 and the exhaust system 510 to keep the cyclone separator 8 warm to minimize condensation of water, as previously discussed.

Figure 19:
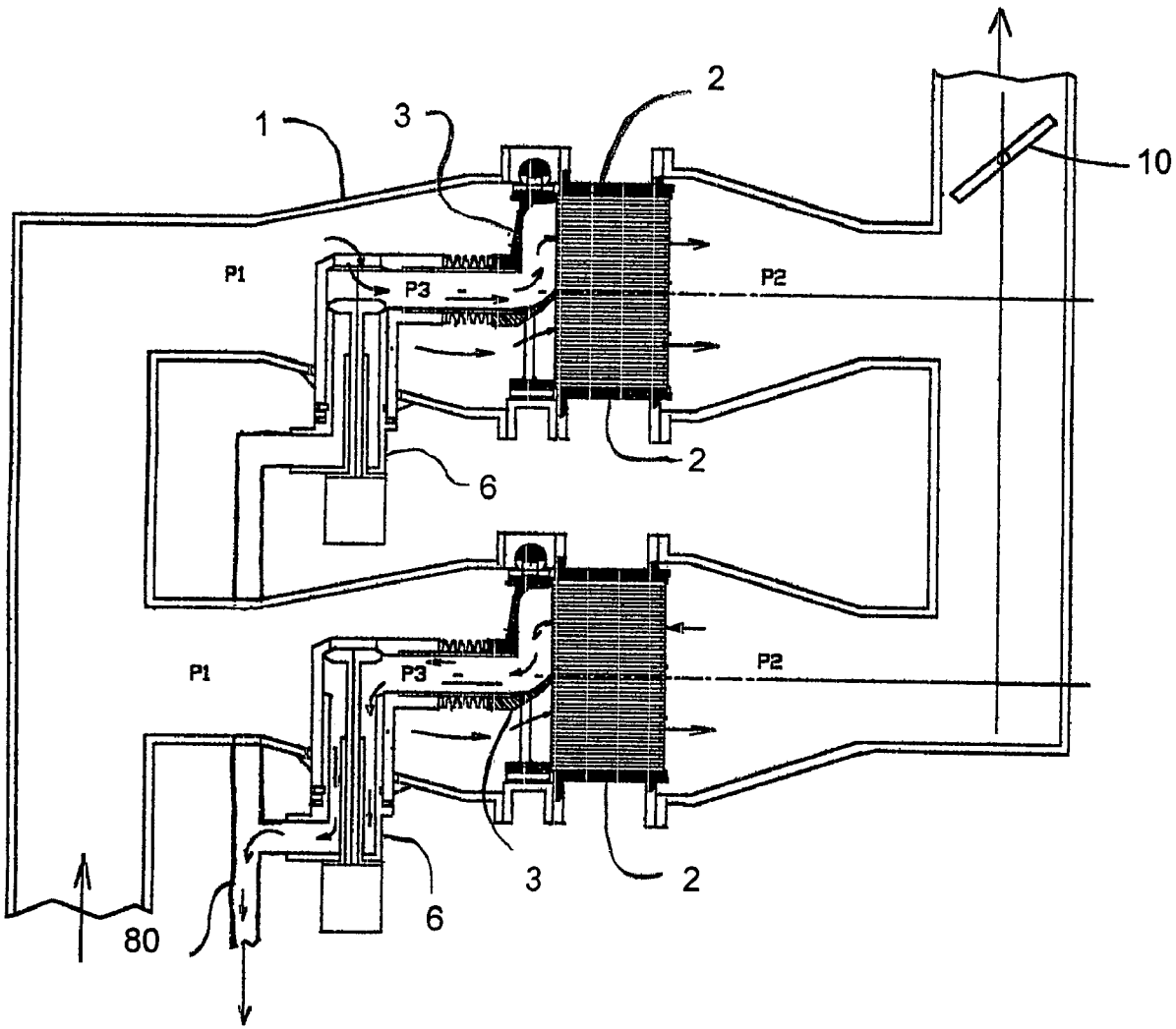
FIG. 19 illustrates a version of the single trap wall-flow particulate trap system for large engines in which the single trap wall-flow particulate trap configurations are duplicated.

FIG. 19 illustrates, schematically, trap systems for use with large industrial, locomotive and marine engines. In these embodiments, the trap system may require two or more particulate traps. As it will be noted, the purge ducts have been connected to a common tube 80 leading to the cyclone separator and the soot igniter and ash receptacle (not shown in the depicted embodiment). Also, only one remote actuated relief valve 10 is employed. The dual trap system 200 includes trap structure 1, two particulate traps 2, two duct valve rotors 3, and two mode valve assemblies 6.

As noted above, the present invention is very compact and can be installed in about any vehicle in which other wall-flow particulate trap systems are used. In addition, because the present invention does not have to be heated to effect regeneration, the present invention can be installed at any desired location in the vehicle exhaust system, such as the usual muffler location. Further, the present invention does not depend on the engine speed and/or load or entail any interaction with the engine control system. The present invention embodies a compact assembly. Finally, because the present invention uses continuous rotation and on/off components, a very simple and dedicated control system can be employed and located at or near the particulate trap system.

For these reasons, the single particulate trap embodiment is well suited to retrofit applications for a wide variety of vehicles, such as transit buses, school buses, automobiles and utility trucks. Similarly, the dual particulate trap system is well suited for retrofit applications for a wide variety of large engine applications which require more than one particulate trap, such as large trucks, locomotives, marine engines and industrial generators. In a first method of retrofitting a vehicle having an exhaust system, the wall-flow particulate trap system is operatively connected to the vehicle's exhaust system. In a second method of retrofitting a vehicle, the exhaust system includes a muffler, the muffler is removed and replaced by the wall-flow particulate trap system. In yet a third method of retrofitting a vehicle, the exhaust system includes a muffler, the muffler is removed and replaced by the particulate trap system, and a muffler is operatively connected to the particulate trap system. In this last method, the muffler may be the original muffler or a muffler of reduced size and/or capacity.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A wall-flow particulate trap system comprising:

a. at least one wall flow particulate trap having porous walls and having an inlet and an outlet, said at least one wall flow particulate trap disposed in an engine exhaust gas line to filter engine exhaust gas and provide filtered exhaust gas;

b. at least one mode valve assembly offset from said inlet of said at least one wall flow particulate trap and having a first and regeneration position wherein when in the first position exhaust gas flows through the assembly to a portion of the at least one wall flow particulate trap and when in the regeneration position exhaust gas flow is restricted through the assembly and a reverse flow of pressurized filtered exhaust gas flows back through a portion of the porous walls of the at least one wall flow particulate trap and through the assembly to regenerate the portion of the at least one wall-flow particulate trap;

c. a relief valve assembly downstream from said outlet of said at least one wall flow particulate trap, and apparatus which remotely actuates the relief valve to a regeneration position to restrict flow of the filtered exhaust gas and raise the pressure thereof to a preselected level to thereby provide said pressurized filtered exhaust gas;

d. at least one duct rotor intermediate said at least one wall flow particulate trap and said at least one mode valve assembly, said at least one duct rotor having a first end and a second end, said second end of said at least one duct rotor in operative communication with said at least one mode valve assembly and at least a portion of said first end of said at least one duct rotor in fluid communication with said inlet of said at least one wall flow particulate trap; and e. at least one rotor drive in driving connection with said at least one duct rotor such that said portion of said first end in fluid communication with said inlet is changeable; and f. an apparatus which actuates the mode valve assembly between the first and regeneration positions.

2. The system of claim 1, wherein said at least one wall flow particulate trap is cylindrical.

3. The system of claim 1, wherein said at least one mode valve assembly is mounted transverse to said exhaust gas line.

4. The system of claim 1, wherein said at least one mode valve assembly has a length substantially no longer than a diameter of said at least one wall flow particulate trap.

5. The system of claim 1, wherein said at least one duct rotor comprises at least one spoke.

6. The system of claim 1, wherein said at least one wall flow particulate trap is located within a surrounding can.

7. The system of claim 1, further comprising a layer of a heat expandable ceramic around said at least one wall flow particulate trap.

8. The system of claim 1, wherein said at least one mode valve assembly is pneumatically actuated.

9. The system of claim 1, wherein said at least one rotor drive comprises a motor and gear train arrangement.

10. The system of claim 9, further comprising a worm gear set.

11. The system of claim 1, wherein said fluid communication of said duct rotor with said at least one wall flow particulate trap is through a minor duct section.

12. The system of claim 11, wherein said minor duct section has a width of 20 to 30 degrees.

13. The system of claim 12, wherein said minor duct section has a width of 25 degrees.

14. The system of claim 1, further comprising a seal for sealing said rotor to said at least one wall flow particulate trap.

15. The system of claim 14, wherein said seal comprises a spring.

16. The system of claim 14, wherein said seal comprises a bellows spring.

17. The system of claim 1, further comprising a purge duct operatively connected to said at least one mode valve assembly.

18. The system of claim 17, wherein said purge duct comprises an integral extended tube.

19. The system of claim 18, further comprising a seal for sealing said rotor to said at least one wall flow particulate trap and said seal is connected to said integral extended tube.

20. The system of claim 17, further comprising a separator operatively connected to said purge duct.

21. The system of claim 20, further comprising an igniter and ash storage chamber operatively connected to said separator.

22. The system of claim 20, wherein said separator is a cyclone separator.

23. The system of claim 22, further comprising a trap structure and said separator is transverse to said trap structure.

24. The system of claim 20, furthering comprising a tube operatively connecting said separator to said at least one mode valve assembly.

25. The system of claim 1, further comprising an actuator operatively connected to said remote relief valve.

26. The system of claim 25, wherein said actuator is connected to said remote relief valve through an actuation shaft.

27. The system of claim 26, wherein said actuator is substantially transverse to said actuation shaft.

28. A wall-flow particulate trap system for an internal combustion engine, the internal combustion engine producing exhaust gas containing soot and ash, the wall-flow particulate trap system comprising:

a. a trap structure having an exhaust gas inlet area and an exhaust gas outlet area;

b. at least one purge duct operatively connected to said trap structure at said exhaust gas inlet area;

c. at least one wall flow particulate trap adapted for mounting within said trap structure, said at least one wall flow particulate trap having an inlet and an outlet, said at least one wall flow particulate trap intermediate said exhaust gas inlet area and said exhaust gas outlet area to receive the engine exhaust gas and provide filtered exhaust gas;

d. at least one mode valve assembly offset from said inlet of said at least one wall flow particulate trap and in fluid communication with said purge duct;

e. a relief valve assembly downstream from said outlet of said at least one wall flow particulate trap, and apparatus which remotely actuates the relief valve to a regeneration position to restrict flow of the filtered exhaust gas and raise the pressure thereof to a preselected level to thereby provide pressurized filtered exhaust gas;

f. at least one duct rotor having a first end and a second end, said second end of said at least one duct rotor operatively connected to said at least one purge duct, said at least one duct rotor including a minor duct section located at said first end, and said minor duct section in fluid communication with said inlet of said at least one wall flow particulate trap;

g. at least one rotor drive in driving connection with said at least one duct rotor; and h. whereby, upon activation of said at least one relief valve, said at least one wall flow particulate trap is regenerated by reverse flow of said pressurized filtered exhaust gas through porous walls of a plurality of passages and through said at least one purge duct.

* * * * *